US007892365B2

(12) United States Patent
Tomizawa et al.

(10) Patent No.: US 7,892,365 B2
(45) Date of Patent: Feb. 22, 2011

(54) RARE EARTH ELEMENT-IRON-BORON ALLOY, AND MAGNETICALLY ANISOTROPIC PERMANENT MAGNET POWDER AND METHOD FOR PRODUCTION THEREOF

(75) Inventors: Hiroyuki Tomizawa, Hirakata (JP); Yuji Kaneko, Uji (JP)

(73) Assignee: Hitachi Metals, Ltd., Minato-ku, Tokyo (JP)

( * ) Notice: Subject to any disclaimer, the term of this patent is extended or adjusted under 35 U.S.C. 154(b) by 279 days.

(21) Appl. No.: 11/950,801

(22) Filed: Dec. 5, 2007

(65) Prior Publication Data

US 2008/0113210 A1 May 15, 2008

Related U.S. Application Data

(62) Division of application No. 10/496,504, filed as application No. PCT/JP02/13268 on Dec. 18, 2002, now Pat. No. 7,550,047.

(30) Foreign Application Priority Data

Dec. 19, 2001 (JP) ..... 2001-385941
Feb. 7, 2002 (JP) ..... 2002-030392

(51) Int. Cl.
*H01F 1/057* (2006.01)

(52) U.S. Cl. ..... 148/302; 148/101; 164/459; 164/461

(58) Field of Classification Search ..... None
See application file for complete search history.

(56) References Cited

U.S. PATENT DOCUMENTS

| | | | | |
|---|---|---|---|---|
| 4,981,532 | A | 1/1991 | Takeshita et al. | |
| 5,383,978 | A | 1/1995 | Yamamoto et al. | |
| 5,908,513 | A | 6/1999 | Sasaki et al. | |
| 7,018,485 | B2 * | 3/2006 | Tsujimoto et al. | 148/101 |
| 2002/0059965 | A1 * | 5/2002 | Honkura et al. | 148/105 |
| 2002/0153062 | A1 | 10/2002 | Hasegawa et al. | |
| 2003/0136469 | A1 * | 7/2003 | Makita et al. | 148/105 |
| 2005/0011588 | A1 * | 1/2005 | Hasegawa et al. | 148/302 |

FOREIGN PATENT DOCUMENTS

| | | |
|---|---|---|
| JP | 08-26112 | 10/1996 |
| JP | 08-260112 | 10/1996 |
| JP | 10-36949 | 2/1998 |
| JP | 2000-178611 | 6/2000 |
| JP | 2000-219942 | 8/2000 |
| JP | 2000-219943 | 8/2000 |
| JP | 2001-176712 | 6/2001 |

* cited by examiner

*Primary Examiner*—John P Sheehan
(74) *Attorney, Agent, or Firm*—Nixon Peabody LLP; Jeffrey L. Costellia

(57) ABSTRACT

A method of making a magnetically anisotropic magnet powder according to the present invention includes the steps of preparing a master alloy by cooling a rare-earth-iron-boron based molten alloy and subjecting the master alloy to an HDDR process. The step of preparing the master alloy includes the step of forming a solidified alloy layer, including a plurality of $R_2Fe_{14}B$-type crystals (where R is at least one element selected from the group consisting of the rare-earth elements and yttrium) in which rare-earth-rich phases are dispersed, by cooling the molten alloy through contact with a cooling member.

9 Claims, 25 Drawing Sheets

(a)

(b)

(c)

(a)

(b)

(c)

(a)

(b)

(c)

(a)

(b)

(c)

50 μm/div

RARE EARTH ELEMENT-IRON-BORON ALLOY, AND MAGNETICALLY ANISOTROPIC PERMANENT MAGNET POWDER AND METHOD FOR PRODUCTION THEREOF

TECHNICAL FIELD

The present invention relates to a rare-earth-iron-boron based alloy, a magnetically anisotropic permanent magnet powder and a method of making such a powder, and an anisotropic bonded magnet including the magnetically anisotropic permanent magnet powder and a method of producing such a magnet.

BACKGROUND ART

A rare-earth-iron-boron based rare-earth magnet is a typical high-performance permanent magnet, has a structure including, as a main phase, an $R_2Fe_{14}B$-type crystalline phase, which is a ternary tetragonal compound, and exhibits excellent magnet performance. In $R_2Fe_{14}B$, R is at least one element selected from the group consisting of the rare-earth elements and yttrium and portions of Fe and B may be replaced with other elements.

Such rare-earth-iron-boron based rare-earth magnets are roughly classifiable into sintered magnets and bonded magnets. A sintered magnet is produced by compacting a fine powder of a rare-earth-iron-boron based magnet alloy (with a mean particle size of several μm) with a press machine and then sintering the resultant compact. On the other hand, a bonded magnet is usually produced by compacting a mixture (i.e., a compound) of a powder of a rare-earth-iron-boron based magnet alloy (with particle sizes of about 100 μm) and a binder resin within a press machine.

The sintered magnet is made of a powder with relatively small particle sizes, and therefore, the respective powder particles thereof exhibit magnetic anisotropy. For that reason, an aligning magnetic field is applied to the powder being compacted by the press machine, thereby obtaining a compact in which the powder particles are aligned with the direction of the magnetic field.

In the bonded magnet on the other hand, the powder particles used have particle sizes exceeding the crystal grain size, and normally exhibit no magnetic anisotropy and cannot be aligned under a magnetic field applied. Accordingly, to produce an anisotropic bonded magnet in which the powder particles are aligned with particular directions, a technique of making a magnetic powder, of which the respective powder particles exhibit the magnetic anisotropy, needs to be established.

To make a rare-earth alloy powder for an anisotropic bonded magnet, an HDDR (hydrogenation-disproportionation-desorption-recombination) process is currently researched and developed. The "HDDR" means a process in which hydrogenation, disproportionation, desorption and recombination are carried out in this order. In this HDDR process, a cast flake or powder of a rare-earth-iron-boron based alloy is maintained at a temperature of 500° C. to 1,000° C. within an $H_2$ gas atmosphere or a mixture of an $H_2$ gas and an inert gas so as to absorb hydrogen. As a result of this hydrogen absorption, the $R_2Fe_{14}B$ phase is decomposed into rare-earth hydrides and iron-based borides. This reaction is represented by any of the following chemical equations:

$$R_2Fe_{14}B+2H_2 \Leftrightarrow 2RH_2+Fe_2B+12Fe \text{ or}$$

$$R_2Fe_{14}B+2H_2 \Leftrightarrow 2RH_2+Fe_3B+11Fe$$

Thereafter, the hydrogenated flake or powder is subjected to a desorption process at a temperature of 500° C. to 1,000° C. and then cooled, thereby obtaining an alloy magnet powder. As a result of this desorption process, the $R_2Fe_{14}B$ phase is regenerated from the hydrides or iron-based borides described above.

The respective $R_2Fe_{14}B$ crystal grains, which had relatively large grain sizes (of several tens of μm or more, for example) before subjected to the hydrogenation process, turn into an aggregation of a huge number of very small $R_2Fe_{14}B$ crystal grains (with grain sizes of approximately 0.1 μm to 1 μm). An aggregation of very small $R_2Fe_{14}B$ crystal grains obtained in this manner will be referred to herein as a "recrystallized texture". The very small $R_2Fe_{14}B$ crystal grains in the recrystallized texture retain the crystallographic orientations of the original big $R_2Fe_{14}B$ crystal grains. Accordingly, if the HDDR processed alloy powder is subjected to pulverization, classification and other processes such that its particle sizes are decreased to the sizes of the crystal grains yet to be subjected to the HDDR process or less, then the crystallographic orientations of those very small $R_2Fe_{14}B$ crystal grains included in the respective powder particles can be aligned with a particular direction, thus realizing magnetic anisotropy. Also, the very small $R_2Fe_{14}B$ crystal grains in the "recrystallized texture" have sizes that are close to the single domain critical grain size, thus achieving high coercivity, too.

Hereinafter, the HDDR process will be described with reference to FIGS. 19(*a*) through 19(*e*).

FIG. 19(*a*) schematically illustrates a portion of a rare-earth-iron-boron based master alloy 1. Since the master alloy 1 is polycrystalline, there are a lot of grain boundaries 3 and not all of the crystallographic orientations 2 of its crystal grains are aligned with each other. Thus, the master alloy 1 is subjected to a coarse pulverization process, thereby forming powder particles 5, each of which is big enough to have a single crystallographic orientation as shown in FIG. 19(*b*). It the powder particles 5 have excessively large particle sizes, then each of those particles 5 will become polycrystalline and the orientations of the crystal grains included in each powder particle 5 will not be aligned with each other. A set of those powder particles 5 will be referred to herein as a "coarsely pulverized powder" 4.

Next, the coarsely pulverized powder 4 is subjected to an HDDR process, thereby giving each particle 5 the recrystallized texture FIG. 19(*c*) illustrates a state in which the recrystallized texture 7 has been formed in each powder particle 5. FIG. 19(*d*) is an enlarged view of the recrystallized texture 7, showing that the crystallographic orientations 2 of the respective crystal grains are aligned with each other in the texture.

Subsequently, as shown in FIG. 19(*e*), the powder particles 5 are either disbanded or finely pulverized, thereby obtaining an alloy powder 9 with magnetic anisotropy.

A method of making a rare-earth-iron-boron based alloy powder with the recrystallized texture by performing such an HDDR process is disclosed in Japanese Patent Gazettes for Opposition No. 6-82575 and No. 7-68561, for example.

The magnetic powder prepared by the HDDR powder (which will be referred to herein as an "HDDR powder", however, has the following drawbacks.

Firstly, to increase the remanence of the HDDR powder, the master alloy must be subjected to a homogenizing process to be carried out at an elevated temperature for a long time (e.g., at 1,100° C. for 20 hours). This process is required because if the master alloy has a fine texture, then the material powder yet to be subjected to the HDDR process will become polycrystalline and the powder particles will become magnetically isotropic.

Also, to subject the master alloy to the HDDR process in its entirety, hydrogen needs to be sufficiently diffused so as to reach the inside of the master alloy. To do so, the hydrogenation process must be carried out for a rather long time (e.g., at 800° C. for six hours). However, the longer the hydrogenation process time, the lower the saturation magnetization tends to be. The reason is as follows. Specifically, as the hydrogenation process lingers, the reversible reactions as represented by the above chemical formulae repeatedly occur an increasing number of times. Then, the crystallographic orientations of the $R_2Fe_{14}B$ phase, which are retained in the master alloy, are gradually lost. As a result, the resultant "recrystallized texture" will have decreased magnetic anisotropy.

Nevertheless, if the hydrogenation process time is shortened, then the HDDR process will be incomplete, an insufficient amount of fine $R_2Fe_{14}B$ phase will be produced, and both the coercivity $H_{cJ}$ and remanence $B_r$ will drop.

To overcome this problem, according to a proposed technique, Ga or any other element is added to the master alloy. In particular, by adding Ga to the master alloy, even if the hydrogenation process is carried out for a rather long time, the crystallographic orientations of the $R_2Fe_{14}B$ phase, retained in the master alloy, are not lost so easily. As a result, both the coercivity $H_{cJ}$ and remanence $B_r$ can be increased to sufficient levels.

However, Ga is an expensive material, and the extended heat treatment for the purpose of hydrogenation increases the manufacturing cost, too. Thus, to mass-produce an HDDR powder at a reduced cost with the properties of the HDDR powder improved, the addition of that expensive Ga needs to be avoided and yet required magnet performance needs to be achieved in a short hydrogenation process time.

In Japanese Patent Gazettes for Opposition No. 6-82575 and No. 7-68561 identified above, a so-called alloy ingot, obtained by melting and casting a material alloy using an induction melting crucible, is used as the master alloy. Recently, however, a method for making a bonded magnet from a powder obtained by subjecting a strip-cast thin-plate material (or alloy flakes) to the HDDR process was also proposed (see Japanese Patent No. 3213638, for example).

However, the strip-cast alloy flakes include substantially no α-Fe phases, have a homogenous texture, but have excessively small crystal grain sizes. Thus, at a powder particle size applicable to a bonded magnet, the respective powder particles exhibit too low magnetic anisotropy to use the powder effectively.

In order to overcome the problems described above, a primary object of the present invention is to provide a rare-earth-iron-boron based alloy, which can eliminate the homogenizing process of the master alloy, can shorten the hydrogenation process time, and can improve both the coercivity $H_{cJ}$ and remanence $J_r$ alike even substantially without adding Ga, and also provide a magnetically anisotropic magnet powder and a method of making the powder and an anisotropic bonded magnet and a method for producing the magnet.

DISCLOSURE OF INVENTION

A method of making a magnetically anisotropic magnet powder according to the present invention includes the steps of preparing a master alloy by cooling a rare-earth-iron-boron based molten alloy and subjecting the master alloy to an HDDR process. The step of preparing the master alloy includes the step of forming a solidified alloy layer, including a plurality of $R_2Fe_4B$-type crystals (where R is at least one element selected from the group consisting of the rare-earth elements and yttrium) in which rare-earth-rich phases are dispersed, by cooling the molten alloy through contact with a cooling member.

In one preferred embodiment, the step of forming the solidified alloy layer includes forming a first texture layer in contact with the cooling member and then further feeding the molten alloy onto the first texture layer to grow the $R_2Fe_{14}B$-type crystals on the first texture layer, thereby forming a second texture layer thereon.

In another preferred embodiment, the first texture layer consists essentially of $R_2Fe_{14}B$-type crystals with an average minor-axis size of less than 20 μm.

In another preferred embodiment, the $R_2Fe_{14}B$-type crystals of the second texture layer have an average minor-axis size of at least 20 μm and an average major-axis size of at least 100 μm.

As used herein, each region consisting of the $R_2Fe_{14}B$-type crystals in the alloy texture refers to a region with the same crystallographic orientation. The "region with the same crystallographic orientation" refers to herein a region showing the same contrast in an image obtained by observing a cross-sectional structure of the alloy with a polarizing microscope.

In another preferred embodiment, the solidified alloy layer includes the first and second texture layers, and the first texture layer accounts for less than 10 vol % of the overall solidified alloy layer.

In another preferred embodiment, the rare-earth-rich phase in the second texture layer is dispersed at an average interval of 50 μm or less in the $R_2Fe_{14}B$-type crystals.

In another preferred embodiment, the master alloy includes at most 5 vol % of α-Fe phase.

In another preferred embodiment, the rare-earth element included in the master alloy has a concentration of 26 mass % to 32 mass %.

In another preferred embodiment, Ga included in the master alloy has a concentration of 0.6 mass % or less.

In another preferred embodiment, the molten alloy is cooled at a rate of 10° C. Is to 1,000° C. Is and at a supercooling temperature of 100° C. to 300° C. in forming the first texture layer. In forming the second texture layer, the molten alloy is cooled at a rate of 1° C./s to 500° C./s.

In another preferred embodiment, the method includes the step of creating gaps in portions of the first texture layer that contact with the cooling member.

In another preferred embodiment, the molten alloy has a temperature of approximately 1,300° C. or less when reaching the cooling member.

In another preferred embodiment, the method includes the step of forming the solidified alloy layer by a centrifugal casting process.

In another preferred embodiment, the step of subjecting the master alloy to the HDDR process includes the step of heating the master alloy up to a temperature of 550° C. to 900° C. and then allowing the master alloy to react to hydrogen.

A rare-earth-iron-boron based alloy according to the present invention includes a first texture layer and a second texture layer, which is obtained by providing a plurality of $R_2Fe_{14}B$-type crystals (where R is at least one element selected from the group consisting of the rare-earth elements and yttrium) where rare-earth-rich phases are dispersed, on the first texture layer. The first texture layer accounts for less than 10 vol % of the overall alloy. The $R_2Fe_{14}B$-type crystals have an average minor-axis size of 20 μm to 110 μm. The rare-earth-rich phases are dispersed at an average interval of 50 μm or less in the $R_2Fe_{14}B$-type crystals.

In one preferred embodiment, the alloy includes at most 5 vol % of α-Fe phase.

In another preferred embodiment, the rare-earth element has a concentration of 26 mass % to 32 mass %.

In another preferred embodiment, Ga has a concentration of 0.6 mass % or less.

A magnetically anisotropic rare-earth-iron-boron based alloy powder according to the present invention has a mean particle size of 10 μm to 300 μm. The concentration of rare-earth elements in powder particles with sizes of 50 μm or less is not higher than that of rare-earth elements in powder particles of which the sizes exceed 50 μm.

In one preferred embodiment, the powder is decrepitated by a hydrogen process.

A magnetically anisotropic rare-earth-iron-boron based alloy magnet powder according to the present invention includes a rare-earth element at a concentration of 26 mass % to 32 mass %, an α-Fe phase at 5 volt or less, and Ga at a concentration of 0.6 mass % or less, and includes a fine texture produced by an HDDR process.

A method for producing an anisotropic bonded magnet according to the present invention includes the steps of preparing a magnetically anisotropic magnet powder by any of the methods described above and mixing the magnetically anisotropic magnet powder with a binder and compacting the mixture under an aligning magnetic field.

An anisotropic bonded magnet according to the present invention includes the magnetically anisotropic rare-earth-iron-boron based alloy magnet powder described above.

A motor according to the present invention includes the anisotropic bonded magnet described above.

BRIEF DESCRIPTION OF DRAWINGS

FIG. 23(*b*) is a graph showing relationships between the rare-earth-rich phase interval and the post-HDDR magnetic properties of the master alloy, in which the abscissa represents the dispersion interval between the rare-earth-rich phases.

BEST MODE FOR CARRYING OUT THE INVENTION

The present inventors acquired the basic idea of the present invention by discovering that the metal texture structure of a master alloy to be subjected to an HDDR process had a significant effect on the time it took to carry out a hydrogenation process. The present inventors carried out an HDDR process on master alloys with various texture structures and evaluated the magnetic properties of the resultant HDDR powders. As a result, the present inventors discovered that by using a master alloy having the metal texture shown in FIG. 1(*d*), even if the $R_2Fe_{14}B$ type crystals as the main phase had an excessively large size, the hydrogenation process could be performed in such a short time that the coercivity could be increased without decreasing the saturation magnetization.

Figure 1:
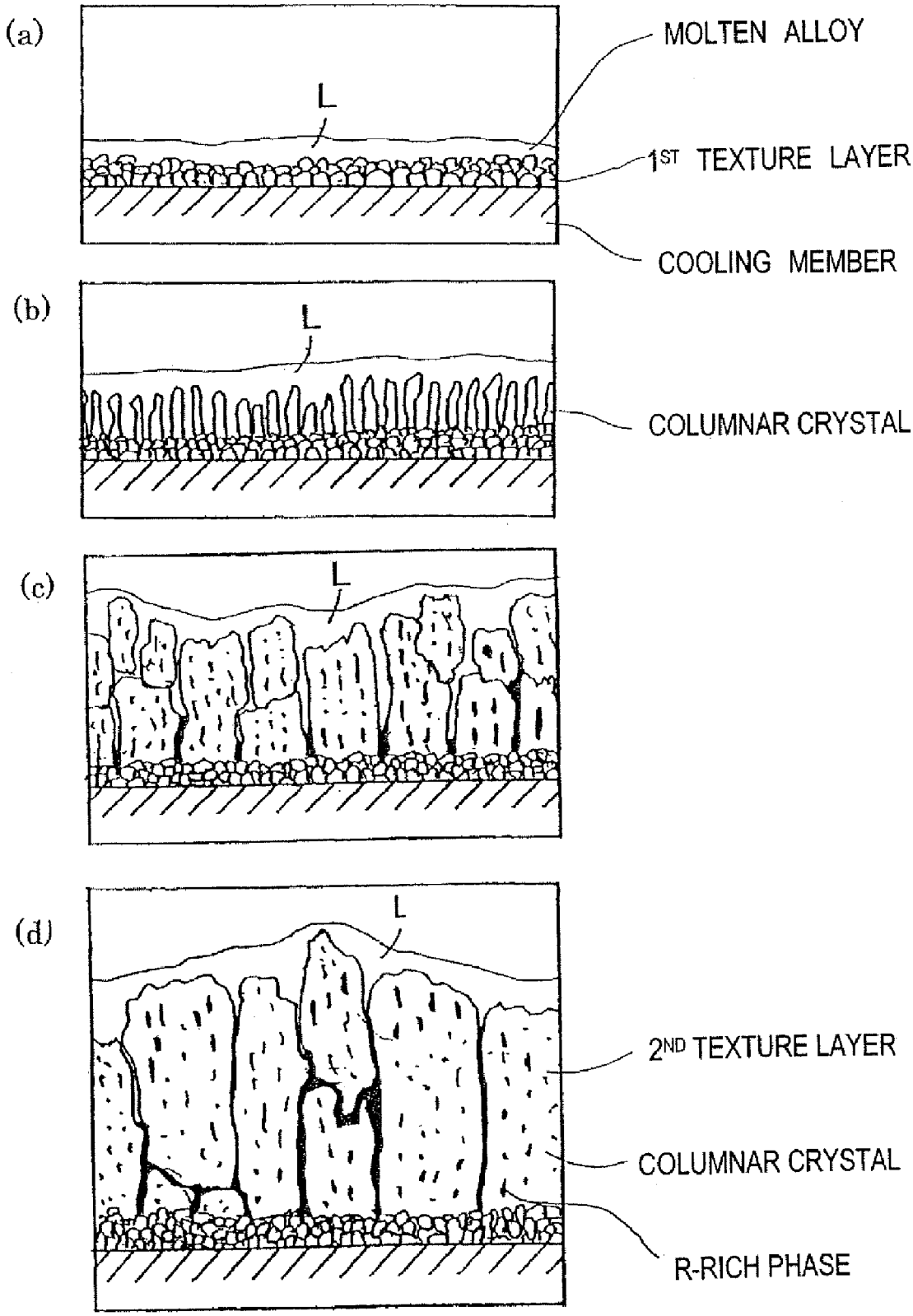
FIGS. 1(*a*) through 1(*d*) are cross-sectional views schematically illustrating how a master alloy for use to make a magnetically anisotropic magnet powder according to the present invention forms its metal texture.

FIG. 1(*d*) schematically illustrates the metal texture of a master alloy for use to make a magnetically anisotropic magnet powder according to the present invention. This master alloy has a structure in which very small rare-earth-rich phases (shown as black dotted regions in FIG. 1(*d*)) are dispersed in relatively coarse columnar crystals. Such a master alloy including a plurality of columnar crystals, in which the rare-earth-rich phases are dispersed, can be formed by cooling a melt of a rare-earth-iron-boron based alloy through contact with a cooling member. The composition of the alloy is close to the stoichiometry of $R_2Fe_{14}B$ type crystals. If necessary, any of various elements may be added to the alloy used. For example, if the composition of the master alloy is represented by $R_xT_{100-x-y-z}B_yM_z$ (in mass percentages) where R is at least one element selected from the group consisting of the rare-earth elements and yttrium, T is Fe and/or Co, B is boron, and M is an additive element, then $26 \leqq x \leqq 32$, $0.95 \leqq y \leqq 1.20$ and $0.01 \leqq z \leqq 2$ (where x, y and z represent mass percentages) are preferably satisfied. M is at least one element selected from the group consisting of Al, Ti, V, Cr, Mn, Ni, Cu, Zn, Ga, Zr, Nb, Mo, In, Sn, Hf, Ta, W and Pb. Also, a portion of B may be replaced with C, N, Si, P and/or S.

Hereinafter, a preferred method of making the master alloy will be described with reference to FIGS. 1(*a*) through 1(*d*).

First, as shown in FIG. 1(*a*), the molten alloy L is brought into contact with a cooling member (e.g., a copper chill plate or chill roller), thereby forming a thin first texture layer, including very small primary crystals (of $R_2Fe_{14}B$), an its side in contact with the cooling member. After the first texture layer has been formed or while the first texture layer is being formed, the molten alloy L is further fed onto the first texture layer, thereby growing columnar crystals (i.e., $R_2Fe_{14}B$ type crystals) on the first texture layer (see FIG. 1(*b*)). These columnar crystals are formed by continuously feeding the molten alloy but cooling the molten alloy at a lower cooling rate than the initial one. As a result, as shown in FIG. 1(*c*), the solidification advances before the rare-earth element, included in the molten alloy supplied relatively slowly, diffuses and reaches the grain boundary of those underlying coarse columnar crystals, thus rapidly growing the columnar crystals in which the rare-earth-rich phases are dispersed. By setting the cooling rate relatively high while primary crystals are being formed during an early stage of the solidification process and by slowing down the cooling rate during the subsequent crystal growth, the second texture layer, including excessively large columnar crystals, can be obtained in the end as shown in FIG. 1(*d*).

In an alloy according to the present invention, the first texture layer is not only unnecessary but also harmful as well for the magnetic powder to exhibit huge magnetization after an HDDR process. Still the first texture layer plays important roles because its surface becomes the nucleus of solidification of the second texture layer and controls the cooling rate of the second texture layer. Thus, the first texture layer is an indispensable element to carry out the present invention. The first texture layer preferably accounts for less than 10 volt, more preferably less than 5 vol %, of the overall alloy. As will be described later, there is a difference in average minor-axis size between the first and second texture layers. Accordingly, if a cross section of the alloy is observed with a microscope, the thickness ratio of these texture layers can be easily calculated, and the volume ratio can be estimated from the thickness ratio.

To form the second texture layer constantly, the solidification rate needs to be controlled strictly. If the solidification rate were too high, the resultant solidified texture would be too fine. However, if the solidification rate was too low, then α-Fe would be produced.

The first texture layer consists essentially of very small $R_2Fe_{14}B$ type crystals, of which the crystal grain sizes are less than 20 μm in an average minor-axis size. Also, the crystallographic orientations of the $R_2Fe_{14}B$ type crystal grains are not identifiable even when observed optically with a polarizing microscope.

On the other hand, the second texture layer consists essentially of excessively large $R_2Fe_{14}B$ type crystals, of which the crystal grain sizes are 20 μm or more in an average minor-axis size and 100 μm or more in an average major-axis size.

With a polarizing microscope, a maze pattern resulting from the crystallographic C planes of the $R_2Fe_{14}B$ type compound or a striped pattern parallel to the cooling member is observed in a portion of the second texture layer where the $R_2Fe_{14}B$ type compound is present. In the second texture layer, the C-axis of the $R_2Fe_{14}B$ type compound is oriented substantially parallel to the cooling member. In other words, this C-axis substantially matches with the minor-axis direction of the crystals.

More specifically, the average minor-axis size of the columnar crystals in the second texture layer is preferably 20 μm to 110 μm, more preferably 60 μm to 110 μm, and most preferably 70 μm to 100 μm. By setting the average minor-axis size of the columnar crystals in the second texture layer within one of these ranges, the coercivity and remanence both increase as will be described later for specific examples of the present invention.

The first and second texture layers, having mutually different average minor-axis sizes, exhibit good magnetic properties when mixed at a predetermined ratio. As described above, if the first texture layer accounts for less than 10 vol % (more preferably less than 5%) of the overall alloy, the HDDR powder exhibits good magnetic properties.

In the $R_2Fe_{14}B$ type crystals making up the second texture layer, rare-earth-rich phases are dispersed at an average space of 50 μm or less. The space is preferably 20 μm to 50 μm on average and more preferably 30 μm to 50 μm on average.

The average minor-axis size of the $R_2Fe_{14}B$ type crystals in the first and second texture layers is defined herein by the following measuring method. Specifically, a cross section of the alloy as taken in the thickness direction is observed with polarizing micrographs (see FIGS. 17 and 18), thereby defining cut lines parallel to the cooling member contact surface. Then, the number No of those cut lines crossing the $R_2Fe_{14}B$ type crystals is counted. The average minor-axis size of the $R_2Fe_14B$ type crystals is represented as Lo/No, where Lo is the length of the cut lines.

The average minor-axis size is measured herein along the cut lines, which are shifted from the cooling member contact surface in the thickness direction. And the range in which the value is less than 20 μm is defined as the first texture layer, while the range in which the value is 20 μm or more is defined as the second texture layer. Then, the volume percentages described above can be calculated based on the ratio of the thickness of each texture layer to that of the overall alloy.

It should be noted that the average minor-axis size of the $R_2Fe_{14}B$ type crystals in the second texture layer is one of the minor-axis sizes to be obtained by the measuring method described above at the center of the thickness of the alloy.

Also, the interval of the rare-earth-rich phases in the second texture layer is obtained by the following measuring method.

When a cross section of the alloy as taken in the thickness direction is observed with backscattering electron images (see FIGS. 24 through 26), rare-earth-rich phases are identified as white ones. On these backscattering electron images, cut lines are defined parallel to the cooling member contact surface. The number N of the cut lines crossing the white rare-earth-rich phases is counted. And based on the number N and the length L of the cut lines, the rare-earth rich phase interval can be obtained as L/N. The cut lines are defined at the center of the thickness of the alloy and an average of a plurality of values, obtained from multiple viewpoints, is calculated.

In forming the first texture layer as an aggregation of very small primary crystals, the molten alloy is preferably cooled at a rate of 10° C./s to 1,000° C. Is and at a supercooling temperature of 100° C. to 300° C. The supercooling can minimize the nucleation of the Fe primary crystals. On the other hand, in forming the second texture layer, the molten alloy is preferably cooled at a rate of 1° C./s to 500° C./s while being fed continuously.

The cooling rate is adjusted according to the rate of feeding the melt onto the cooling member. Thus, to obtain the alloy texture described above, it is important to adopt a cooling method that allows for adjustment of the melt feeding rate. More specifically, to obtain the alloy texture of the present invention, the melt is preferably constantly fed little by little onto a cooling member (such as a casting mold). For that reason, a cooling process of scattering or atomizing droplets of the melt is preferably carried out. For example, a method of atomizing a melt flow by blowing a gas jet against it or a method of scattering the droplets with centrifugal force may be adopted.

To control the cooling rate of the second texture layer more easily, the following method may be adopted. That method is creating gaps in the first texture layer being formed so as to reduce the substantial heat transfer cross-sectional area of the first texture layer. Then, even if the melt feeding rate is not reduced while the second texture layer is being formed, the cooling rate of the second texture layer decreases as the heat transfer cross-sectional area decreases. Optionally, while the gaps are being created in the first texture layer, the melt feeding rate may be adjusted.

Hereinafter, a preferred method of making the master alloy with those gaps created in the first texture layer will be described with reference to FIGS. 27(*a*) through 27(*e*).

Figure 27:
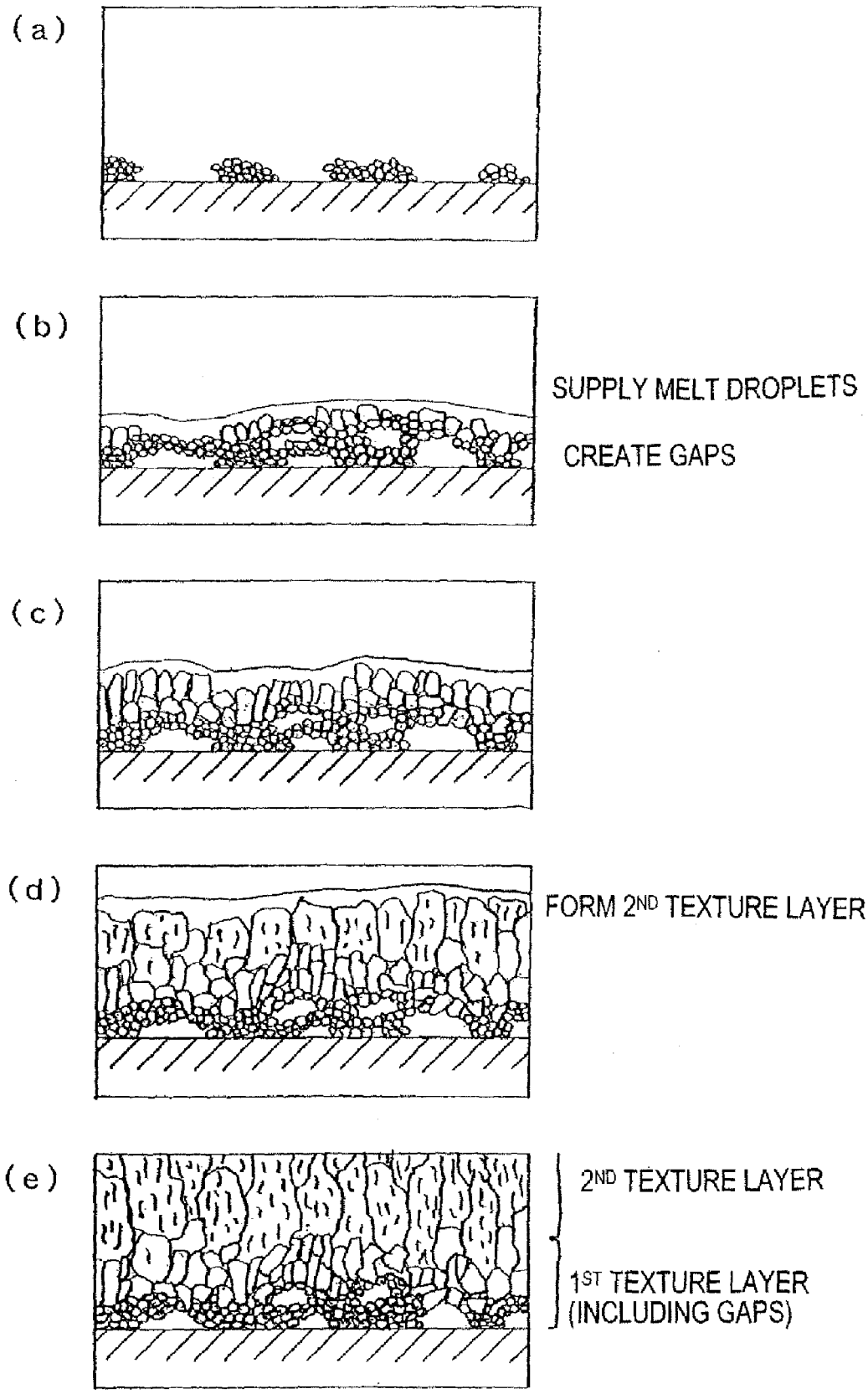
FIGS. 27(*a*) through 27(*e*) are cross-sectional views schematically illustrating how a master alloy for use to make a magnetically anisotropic magnet powder according to the present invention forms its metallurgical structure.

First, as shown in FIG. 27(*a*), melt droplets are fed onto a cooling member, thereby producing initial very small $R_2Fe_{14}B$ type crystals. FIG. 27(*b*) shows how gaps have been created. There is a just supplied melt on the solidified layer.

By feeding the melt, coarse $R_2Fe_{14}B$ type crystals start to grow on the first texture layer as shown in FIG. 27(*c*), thus causing a transition from the first texture layer to the second texture layer. FIGS. 27(*d*) and 27(*e*) show how the second texture layer grows. The gaps on the cooling surface remain even after these two layers have been solidified.

To create those gaps in the first texture layer, a melt with a relatively high viscosity may be atomized. Specifically, according to a method, the temperature of the melt is decreased from 1,450° C., which is adopted in a normal alloy casting process, to about 1,300° C. or less when the melt reaches the cooling member.

The temperature of the melt may be controlled by a method in which the melt is turned into atomized droplets and then has its heat dissipated while traveling to the cooling member. Specifically, a method in which the atmosphere in a furnace filled with an inert gas is maintained around at the atmospheric pressure or a method of atomizing the melt with an inert gas may be adopted. An Ar gas is normally used as an inert gas. Alternatively, a He gas may be used instead. By using the He gas, the melt droplets can dissipate more heat.

The percentage of the gaps to the overall first texture layer may be represented on the contact surface between the cooling member and the master alloy. If the cross-sectional texture of the master alloy as taken in the thickness direction is observed, then the surface contacting with the cooling member and the gaps can be easily distinguished from each other. Accordingly, the percentage of the gaps may be represented as a ratio of the total length of the gaps to that of the cooling surface. In the alloy of the present invention, the gap percentage falls within the range of 20% to 70%.

Another point in the melt quenching method of the present invention is to collect the produced melt droplets on the cooling member at a high yield (i.e., use the droplets efficiently enough to make a solidified alloy). To increase the yield, a method of blowing the melt droplets onto a flat-plate cooling member with a gas spray or a method of scattering the melt droplets against the inner walls of a rotating drum-like cooling member (i.e., a centrifugal casting process) is preferably adopted.

No solidified alloy with such a texture structure could be obtained by any conventional method such as a strip casting process or an alloy ingot process. Hereinafter, it will be described how crystals grow in a solidified alloy (or master alloy) made by a conventional process.

Figure 2:
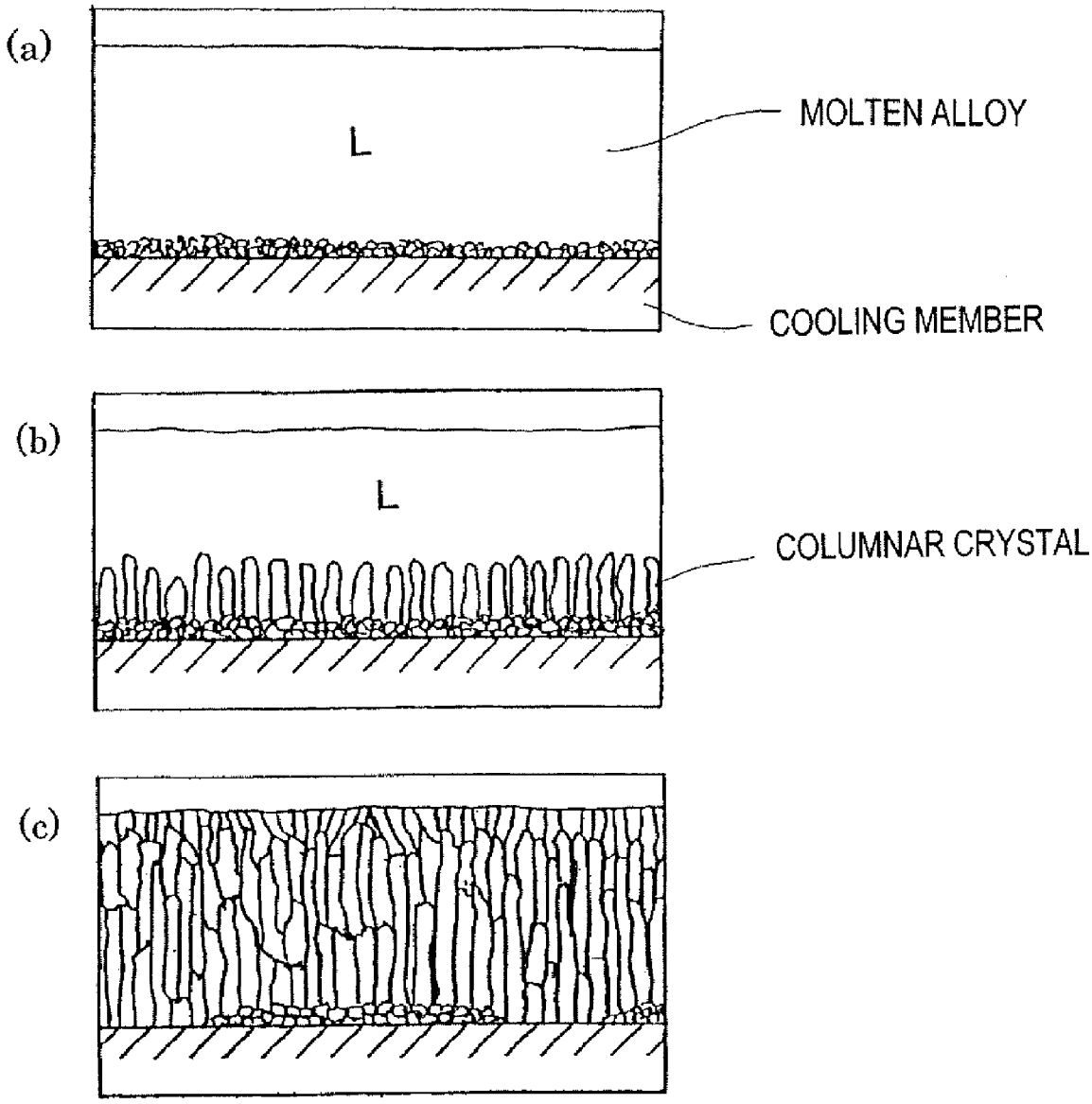
FIGS. 2(*a*) through 2(*c*) are cross-sectional views schematically illustrating how the metal structure of a master alloy is formed by a strip casting process.

First, it will be described with reference to FIGS. 2(*a*) through 2(*c*) how crystals grow in a strip casting process. A strip casting process results in a relatively high cooling rate. Accordingly, a molten alloy L, having contacted with a cooling member such as a chill roller that is rotating at a high speed, is rapidly cooled and solidified from its contact surface. To achieve a high cooling rate, the amount of the molten alloy L needs to be decreased. Also, considering the structure of the strip caster, the molten alloy cannot be supplied sequentially. Accordingly, the thickness of the molten alloy L on the cooling member does not increase, but remains substantially constant, throughout the quenching process. In the molten alloy L with such a constant thickness, the crystal growth advances rapidly from the surface contacting with the cooling member. Since the cooling rate is high, the minor-axis sizes of the columnar crystals are small as shown in FIGS. 2(*a*) through 2(C), and the resultant solidified alloy has a fine metal texture. The rare-earth-rich phases are not present inside of the columnar texture but are dispersed on the grain boundary. In the strip-cast alloy, the crystal grains have such small sizes that regions with aligned crystal orientation are small. Accordingly, when the powder should have particle sizes applicable to a bonded magnet, the magnetic anisotropy of the respective powder particles decrease.

Figure 3:
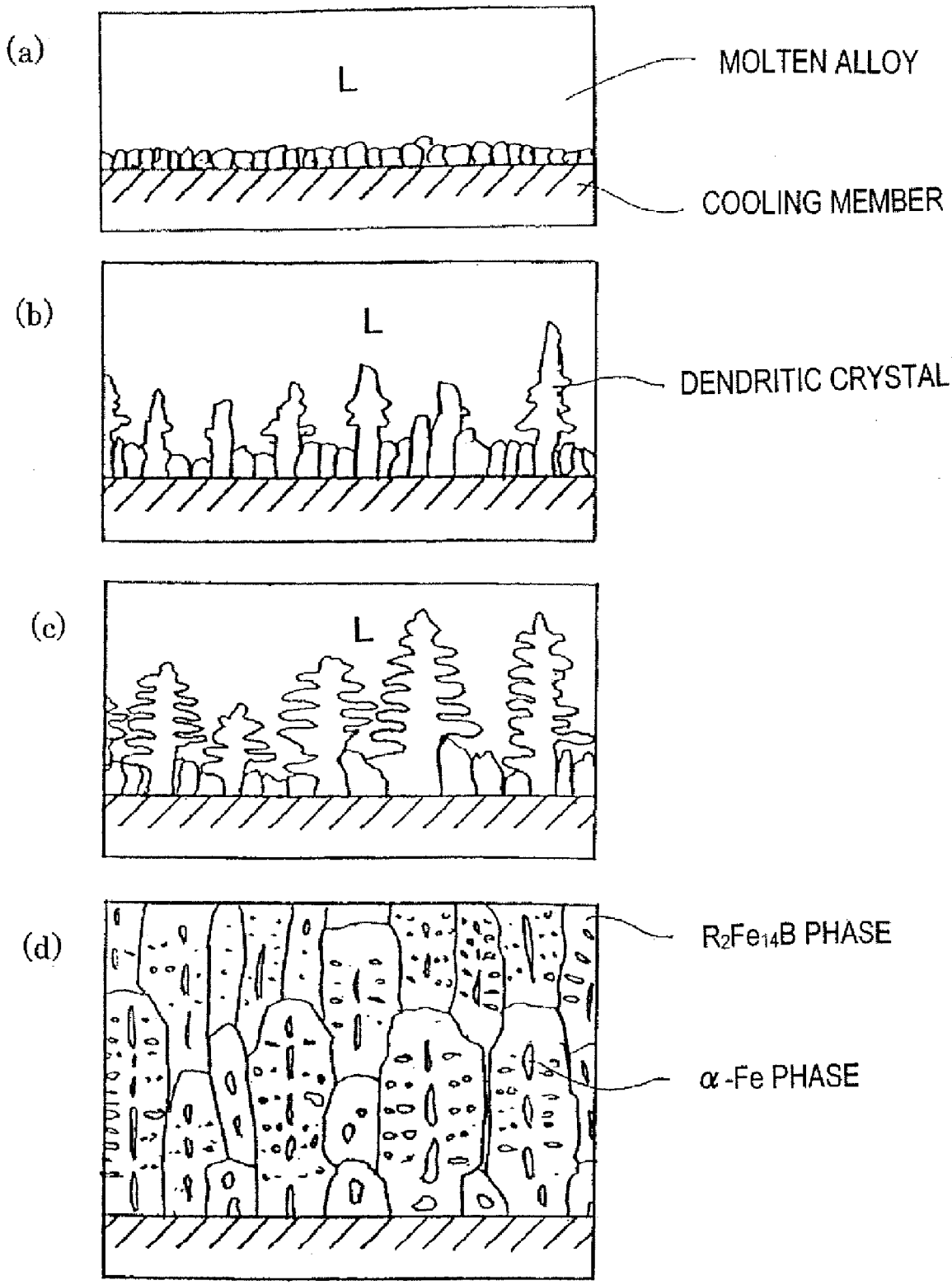
FIGS. 3(*a*) through 3(*d*) are cross-sectional views schematically illustrating how the metal structure of a master alloy is formed by a conventional ingot casting process.

Next, it will be described with reference to FIGS. 3(*a*) through 3(*d*) how crystals grow in a conventional ingot casting process. An ingot casting process results in a relatively low cooling rate. Accordingly, a molten alloy L, having contacted with a cooling member, is slowly cooled and solidified from that contact surface. Inside of the still molten alloy L, first, Fe primary crystals are produced on the surface contacting with the cooling member and then dendritic crystals of Fe are going to grow as shown in FIGS. 3(*b*) and 3(*c*). An $R_2Fe_{14}B$ type crystalline phase is finally formed by a peritectic reaction but still includes some α-Fe phases that would deteriorate the magnet performance. The solidified alloy has a coarse metal texture and includes more than 2 vol % of big α-Fe phases. To decrease the α-Fe, a homogenizing process needs to be carried out. Specifically, by diffusing and eliminating the α-Fe and $R_2Fe_{17}$ phases in the ingot alloy as much as possible, the resultant texture should be made to consist essentially of the $R_2Fe_{14}B$ and R-rich phases only. The homogenizing heat treatment is carried out at a temperature of 1,100° C. to 1,200° C. for 1 to 48 hours within either an inert atmosphere (except a nitrogen atmosphere) or a vacuum. Such a homogenizing treatment adversely increases the manufacturing cost. Meanwhile, to minimize the production of the α-Fe, the mole fraction of the rare-earth element included in the material alloy needs to be sufficiently greater than that defined by stoichiometry. However, if the mole fraction of the rare-earth element is increased, then the remanence of the resultant magnet will decrease and the corrosion resistance thereof will deteriorate, which are problems.

In the master alloy for use in the present invention (see FIGS. 1 and 27), the mole fraction of the rare-earth element included is close to that defined by the stoichiometry but the α-Fe is not produced so easily. Accordingly, the amount of the rare-earth element included can be lower than the conventional one. Furthermore, in the master alloy for use in the present invention, the main phase is bigger than that of a strip-cast alloy, thus achieving high magnetic anisotropy through an HDDR process. For that reason, the master alloy can be used effectively to make a magnetically anisotropic magnet powder.

Using a master alloy with such a texture, even if the concentration of the rare-earth element is defined within the range of 26 mass % to 32 mass %, the α-Fe phase included in the as-cast master alloy yet to be thermally treated can have a small size and its percentage can be reduced to 5 vol % or less. Accordingly, even without the homogenizing heat treatment to be carried out on a master alloy to make a conventional ingot alloy, the magnetic properties of the HDDR powder (e.g., coercivity among other things) would never be affected.

Hereinafter, it will be described what differences will be made when those master alloys having various texture structures are subjected to an HDDR process.

Figure 4:
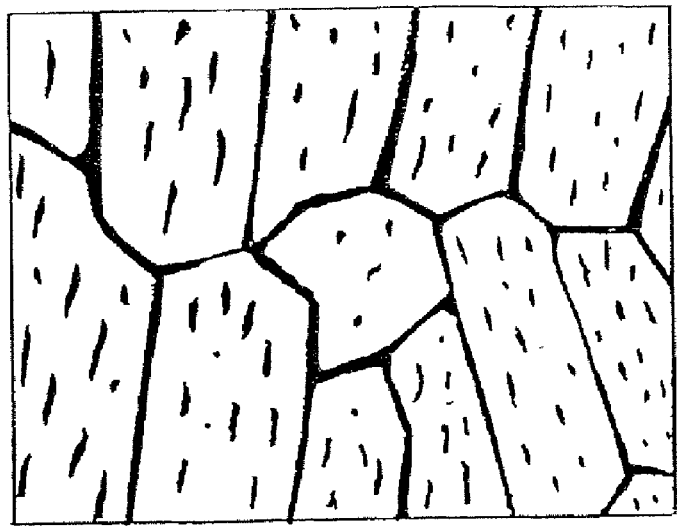
FIGS. 4(*a*), 4(*b*) and 4(*c*) schematically illustrate the textures of the master alloy of the present invention, a conventional ingot cast alloy, and a strip cast alloy, respectively, at a time T1 before these alloys are subjected to an HDDR process.
Figure 4:
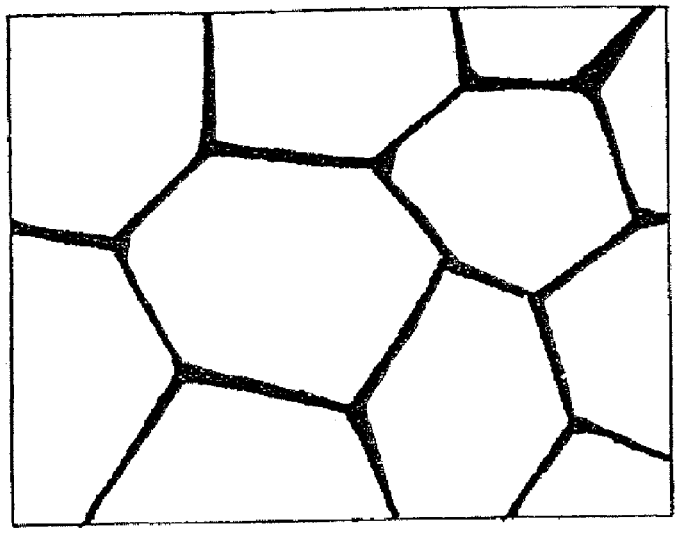
Figure 4:
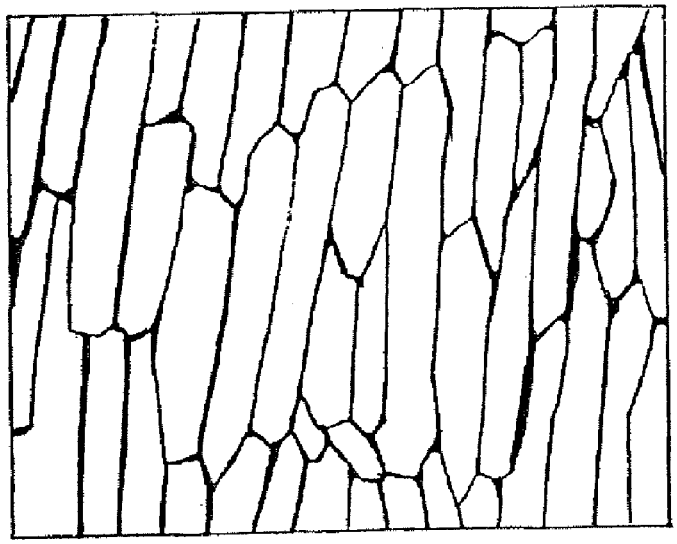

FIGS. 4(*a*), 4(*b*) and 4(*c*) schematically illustrate the textures of the master alloy of the present invention, a conventional ingot cast alloy, and a strip cast alloy, respectively, at a time T1 before these alloys are subjected to the HDDR process. As shown in FIGS. 4(*a*) through 4(*c*), the $R_2Fe_{14}B$ type crystalline phase of the conventional ingot cast alloy is coarse, but the $R_2Fe_{14}B$ type crystalline phase of the strip-cast alloy has small minor-axis grain sizes On the other hand, in the master alloy of the present invention, the average grain size of the $R_2Fe_{14}B$ type crystalline phase is greater than that of the $R_2Fe_{14}B$ type crystalline phase of the strip-cast master alloy, and rare-earth-rich phases are dispersed inside of the $R_2Fe_{14}B$ type crystalline phases.

Figure 5:
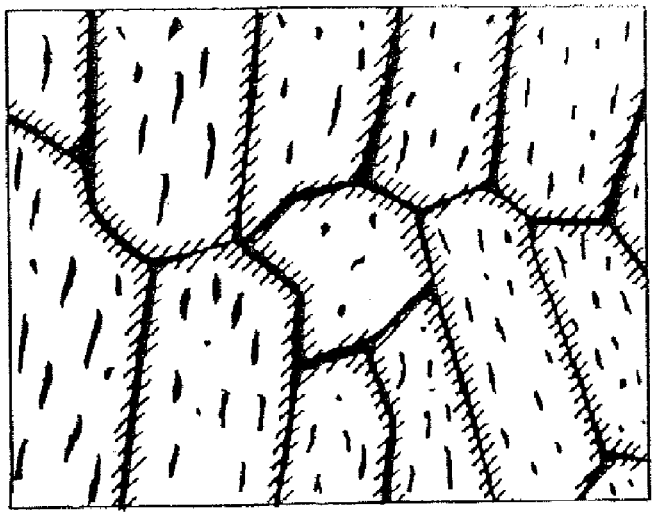
FIGS. 5(*a*), 5(*b*) and 5(*c*) schematically illustrate the textures of the master alloy of the present invention, the conventional ingot cast alloy, and the strip cast alloy, respectively, at a time T2 after those alloys have started being subjected to the HDDR process (where T1<T2).
Figure 5:
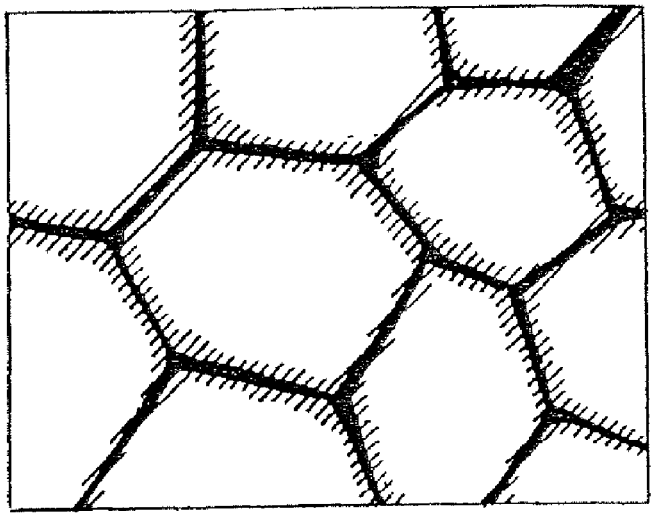
Figure 5:
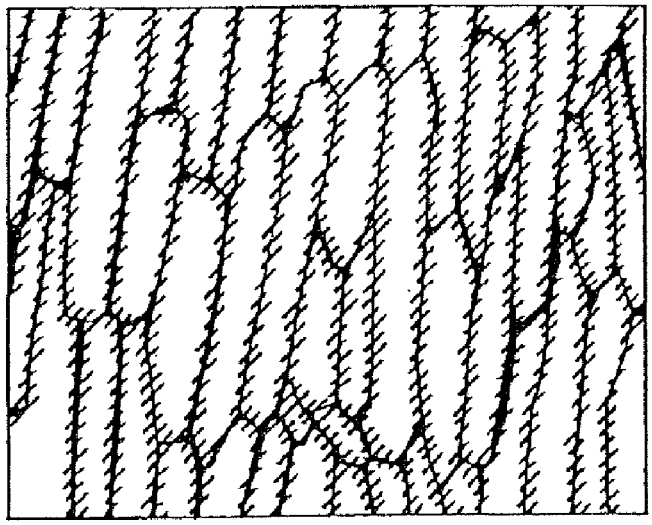

FIGS. 5(*a*), 5(*b*) and 5(*c*) schematically illustrate the textures of the master alloy of the present invention, the conventional ingot cast alloy, and the strip cast alloy, respectively, at a time T2 after those alloys have started being subjected to the HDDR process (where T1<T2). In FIGS. 5(*a*) through 5(*c*), the hatched portions indicate portions that have reacted to hydrogenation. This reaction is advanced by hydrogen atoms diffusing through lattice defects of the main phase and cracks that have been produced due to hydrogen absorption of surface portions. The hydrogen atoms easily diffuse through not just those lattice defects but also a grain boundary. Accordingly, the hydrogenation reaction advances inward from the grain boundary portion of the $R_2Fe_{14}B$ type crystalline phases.

Figure 6:
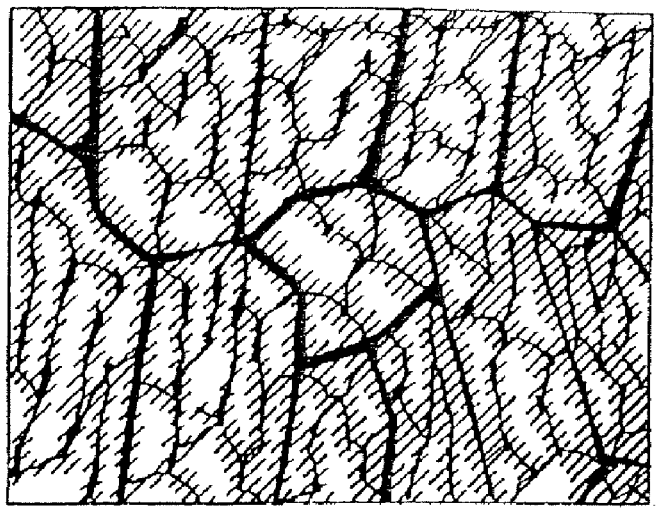
FIGS. 6(*a*), 6(*b*) and 6(*c*) schematically illustrate the textures of the master alloy of the present invention, the conventional ingot cast alloy, and the strip cast alloy, respectively, at a time T3 after those alloys have started being subjected to the HDDR process (where T2<T3).
Figure 6:
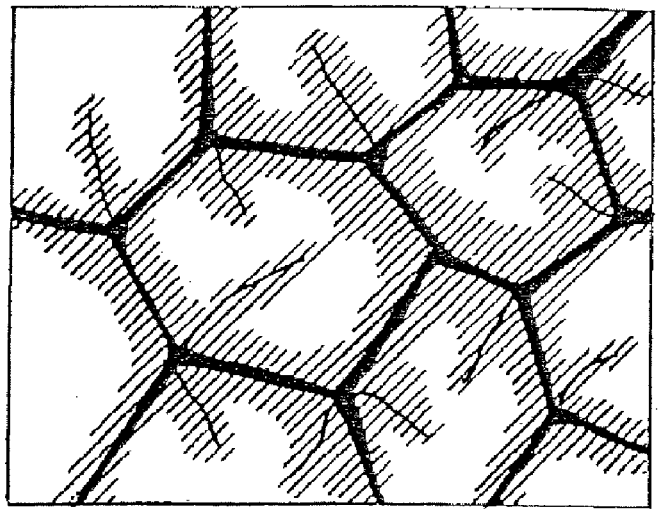
Figure 6:
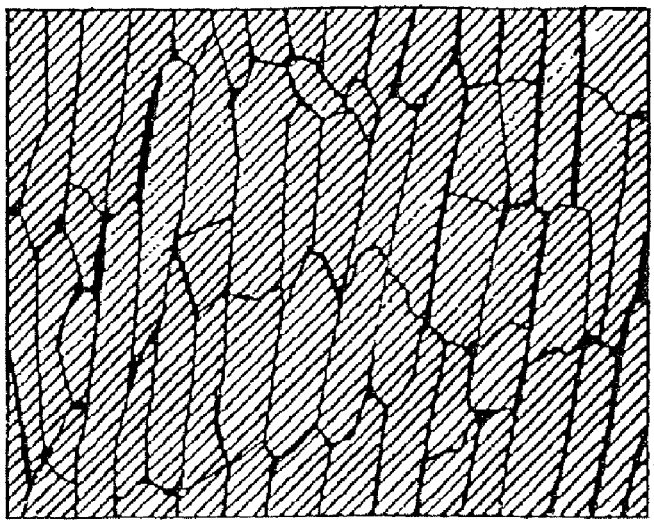

FIGS. 6(*a*), 6(*b*) and 6(*c*) schematically illustrate the textures of the master alloy of the present invention, the conventional ingot cast alloy, and the strip cast alloy, respectively, at a time T3 after those alloys have started being subjected to the HDDR process (where T2<T3). As can be seen from FIGS. 6(*a*) and 6(*b*), the hydrogenation reaction has advanced quickly in the strip-cast alloy with small minor-axis grain sizes, but the coarse $R_2Fe_{14}B$ type crystal grains of the conventional ingot cast alloy include a lot of non-reacted portions that have not been hydrogenated sufficiently yet. In contrast, in the master alloy of the present invention, although the crystal grain sizes are relatively large, the hydrogenation reaction has advanced in a broad area at a rather early stage. The reason why the hydrogenation reaction advances that quickly in the master alloy of the present invention is believed to be that the rare-earth-rich phases, dispersed in the $R_2Fe_{14}B$ type crystal grains, should have formed a hydrogen diffusion path.

Figure 7:
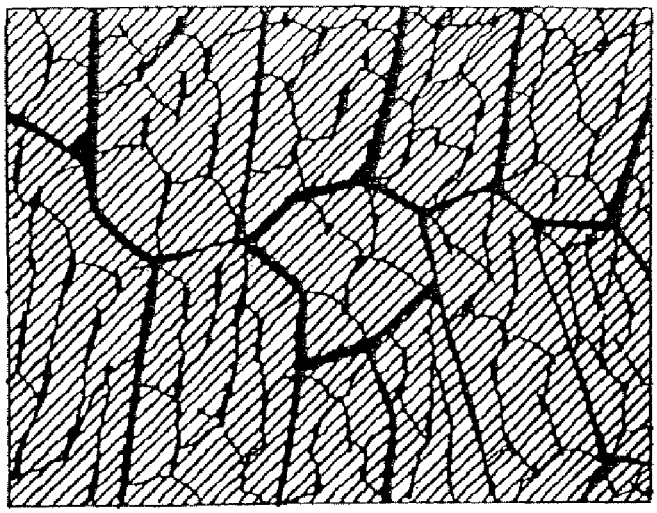
FIGS. 7(*a*), 7(*b*) and 7(*c*) schematically illustrate the textures of the master alloy of the present invention, the conventional ingot cast alloy, and the strip cast alloy, respectively, at a time T4 after those alloys have started being subjected to the HDDR process (where T3<T4).
Figure 7:
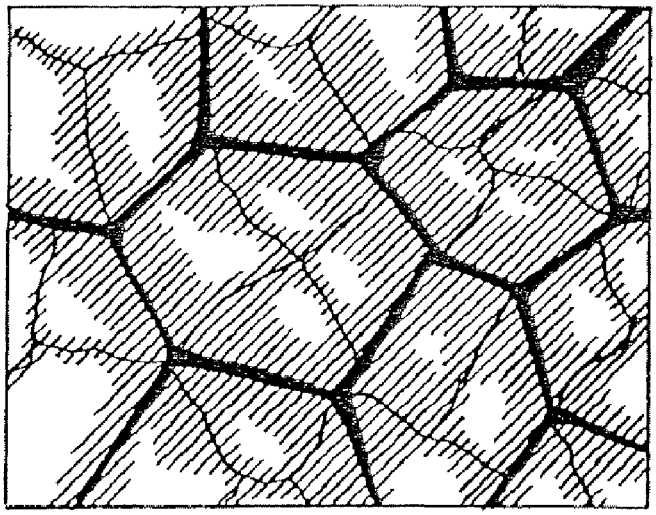
Figure 7:
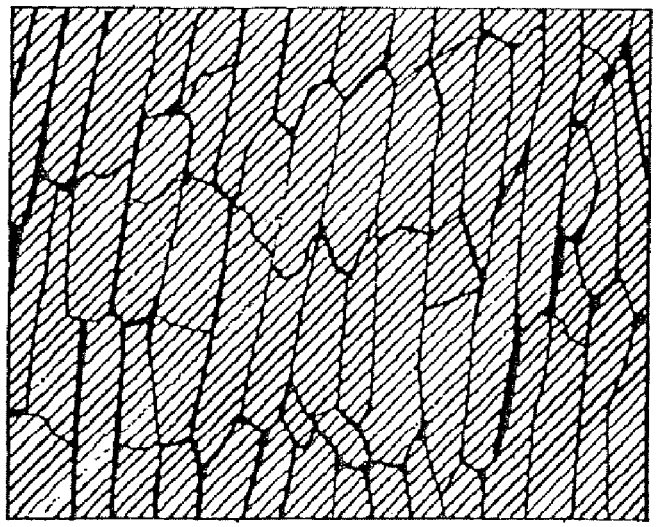

FIGS. 7(*a*), 7(*b*) and 7(*c*) schematically illustrate the textures of the master alloy of the present invention, the conventional ingot cast alloy, and the strip cast alloy, respectively, during the HDDR process. The textures schematically illustrated in FIGS. 7(*a*) through 7(*c*) are produced at a time T4 after those alloys have started being subjected to the HDDR process (where T3<T4 and T4 may be 30 minutes to 60 minutes, for example). The conventional ingot cast alloy still includes non-reacted portions that have not been hydrogenated yet, while almost all of the master alloy of the present invention has been hydrogenated sufficiently. It should be noted that when subjected to an appropriate dehydrogenation process after that, the hydrogenated portions will be turned into the recrystallized texture described above.

Figure 8:
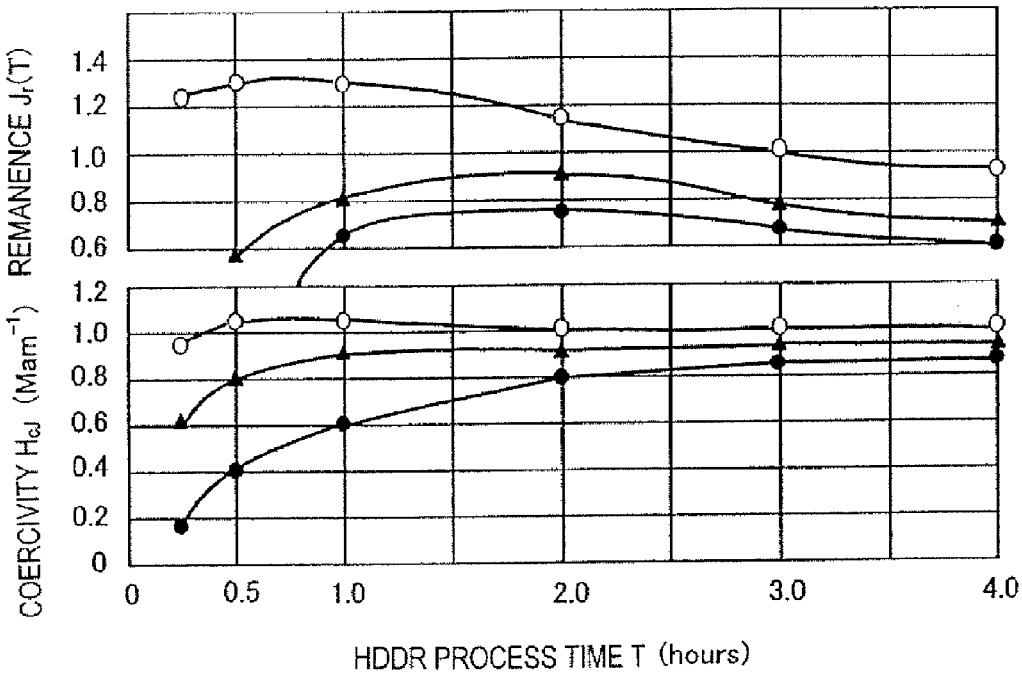
FIG. 8 shows a graph showing relationships between the remanence $J_r$ and the HDDR process time and a graph showing relationships between the coercivity $H_{cJ}$ and the HDDR process time.

FIG. 8 shows a graph showing relationships between the remanence $B_r$ and the hydrogenation process time T of the HDDR process and a graph showing relationships between the coercivity $H_{cJ}$ and the hydrogenation process time T. In FIG. 8, the data points ○ represent the alloy of the present invention, the data points ● represent the conventional ingot cast alloy, and the data points ▲ represent the strip-cast alloy. The alloy had a composition consisting essentially of 27.5 mass % of Nd, 0.1 mass % of Zr, 1.0 mass % of B and Fe as the balance. Before subjected to the HDDR process, the alloy was subjected to a hydrogen decrepitation process within a hydrogen atmosphere of 0.3 MPa for two hours, and then coarsely pulverized to sizes of 425 μm or less. Thereafter, the HDDR process was carried out under the following conditions.

First, the hydrogenation process was carried out for the amount of time shown in these graphs within a hydrogen atmosphere at a pressure of 0.1 MPa and at a temperature of 850° C. Thereafter, substitution with an argon gas was carried out for 5 minutes. Subsequently, the alloy was subjected to a dehydrogenation process within an argon atmosphere at a temperature of 850° C. and a pressure of 1.0 kPa for 30 minutes. Then, the alloy was cooled to room temperature.

As can be seen from FIG. 8, as the process time increases, the coercivity $H_{cJ}$ increases during an initial stage of the hydrogenation process, but is soon saturated. Even if the hydrogenation process time is 1 hour or less, the alloy of the present invention exhibits sufficiently high coercivity. This means that hydrogen atoms have rapidly diffused to reach the inside of the coarse powder and finish the hydrogenation reaction at an early stage. In the strip cast alloy or ingot cast alloy on the other hand, it takes a long time for the coercivity to reach its saturation level. In the ingot cast alloy among other things, sufficient coercivity was not achieved unless the alloy was subjected to the hydrogenation process for at least two hours.

The remanence $B_r$ soon reached its peak after the hydrogenation process had started. Thereafter, the remanence $B_r$ decreased as the hydrogenation process lasted longer. This is because the longer the hydrogenation process, the reversible reactions of hydrogenation and dehydrogenation occur repeatedly, thus gradually erasing the crystallographic orientation that is memorized in the master alloy as described above.

When the alloy of the present invention is used, sufficiently high coercivity $H_{cJ}$ is achieved in a shorter hydrogenation process time than any other alloy. Thus, an HDDR powder with excellent coercivity $H_{cJ}$ and excellent remanence $J_r$ can be obtained.

Figure 9:
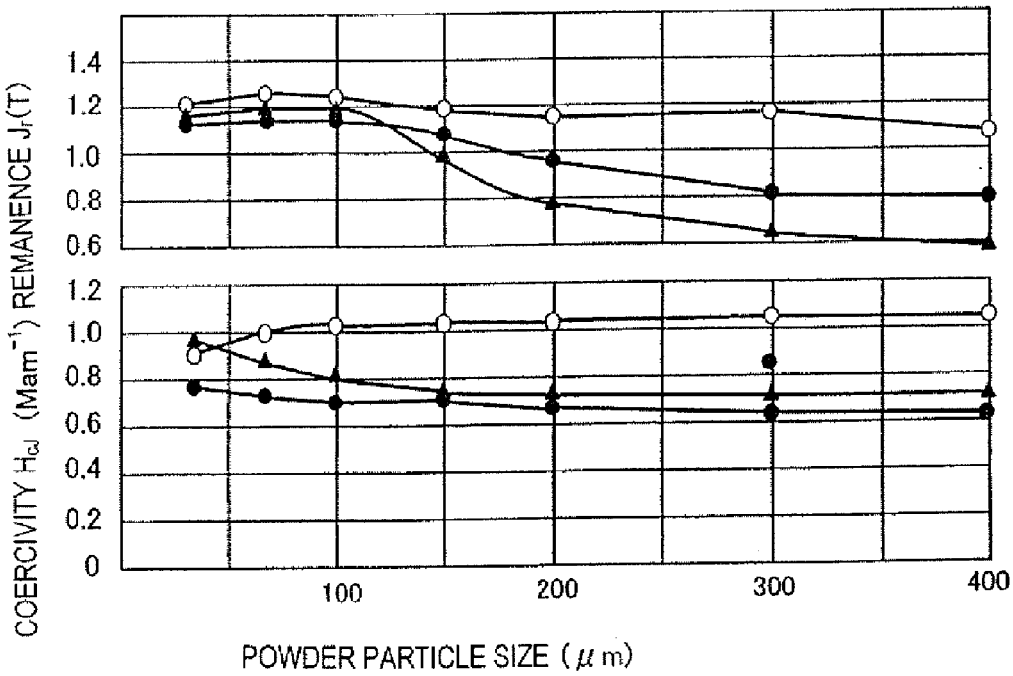
FIG. 9 shows a graph showing relationships between the remanence $J_r$ and the mean particle size and a graph showing relationships between the coercivity $H_{cJ}$ and the mean particle size.

FIG. 9 shows graphs representing the mean particle size dependences of the remanence $J_r$ and coercivity $H_{cJ}$. In FIG. 9, the data points ○ represent the alloy of the present invention, the data points ● represent the conventional ingot cast alloy, and the data points ▲ represent the strip-cast alloy.

The coercivity usually decreases as the mean particle size increases. In the alloy of the present invention, however, even if the mean particle size is relatively large, the remanence $J_r$ does not decrease so much. This is believed to be because in the present invention, the master alloy has large crystal grain sizes and a recrystallized texture with aligned crystal orientations should be present in a broader area. In addition, in the present invention, even if the mean particle size increases, the coercivity hardly decreases.

Example 1

First, master alloys, having the compositions shown in the following Table 1, were made by a centrifugal casting process. More specifically, a melt of a rare-earth-iron-boron based alloy (at a temperature of approximately 1,300° C.) was scattered by centrifugal force toward the inner walls of a rotating cylindrical cooling member. In this manner, master alloys having a texture such as that shown in FIG. 1(*d*) were obtained. The numerical values representing the compositions in Table 1 are mass percentages.

TABLE 1

| Sample No. | Nd | Pr | Fe | Co | Ga | Zr | Al | Cu | B |
|---|---|---|---|---|---|---|---|---|---|
| 1 | 27.6 | 0.17 | 60.1 | 10.00 | 0.48 | 0.10 | 0.06 | 0.00 | 1.02 |
| 2 | 29.8 | 0.19 | 58.1 | 10.04 | 0.48 | 0.10 | 0.07 | 0.00 | 1.02 |
| 3 | 27.5 | 0.15 | 70.3 | — | — | 0.04 | 0.09 | 0.00 | 0.97 |
| 4 | 29.5 | 0.18 | 68.4 | — | — | 0.04 | 0.08 | 0.00 | 0.98 |
| 5 | 31.3 | 0.18 | 66.5 | — | — | 0.04 | 0.09 | 0.00 | 0.97 |
| 6 | 27.6 | 0.20 | 68.2 | 1.96 | — | 0.04 | 0.08 | 0.00 | 1.01 |
| 7 | 27.6 | 0.17 | 65.4 | 4.97 | — | 0.05 | 0.08 | 0.00 | 1.00 |
| 8 | 31.3 | 0.21 | 64.5 | 1.96 | — | 0.04 | 0.07 | 0.00 | 0.98 |
| 9 | 31.4 | 0.20 | 61.5 | 4.96 | — | 0.04 | 0.06 | 0.00 | 1.00 |
| 10 | 27.5 | 0.19 | 65.4 | 5.03 | 0.08 | 0.05 | 0.06 | 0.01 | 1.01 |
| 11 | 31.4 | 0.21 | 61.4 | 5.01 | 0.08 | 0.05 | 0.08 | 0.01 | 1.01 |
| 12 | 27.6 | 0.19 | 64.9 | 5.00 | 0.18 | 0.05 | 0.06 | 0.01 | 1.02 |
| 13 | 27.6 | 0.18 | 64.7 | 5.00 | 0.48 | 0.05 | 0.07 | 0.01 | 1.01 |

Figure 17:
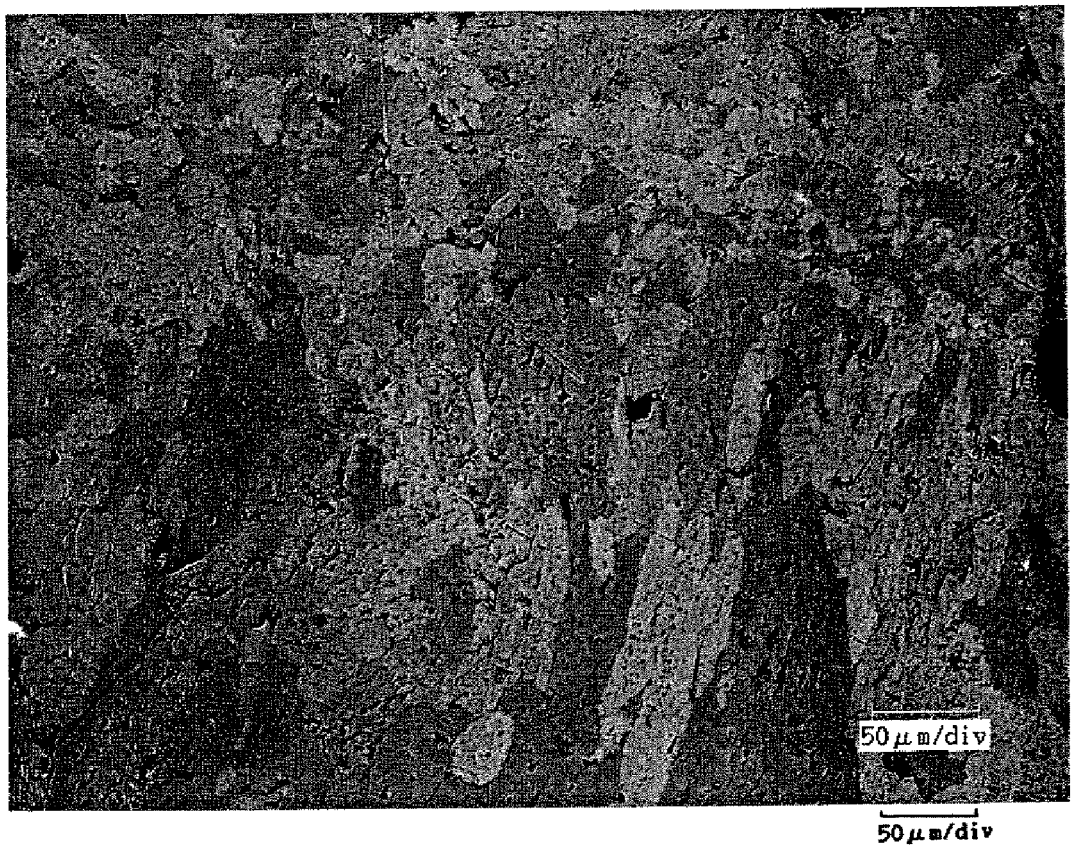
FIG. 17 is a polarizing micrograph of a master alloy according to the present invention showing a texture cross section near its surface contacting with a cooling member.
Figure 18:
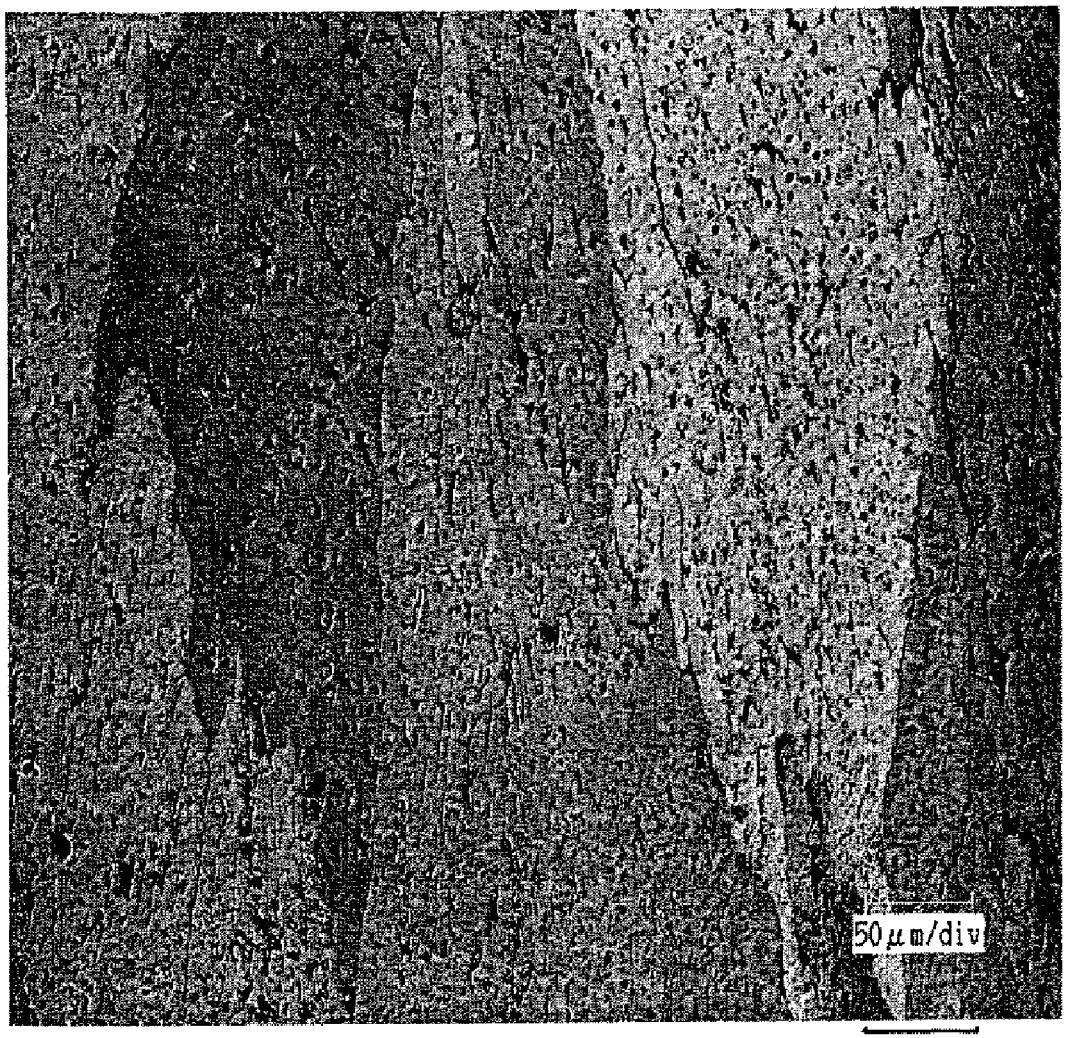
FIG. 18 is a polarizing micrograph of a master alloy according to the present invention showing a texture cross section of a center portion in the thickness direction.
Figure 19:
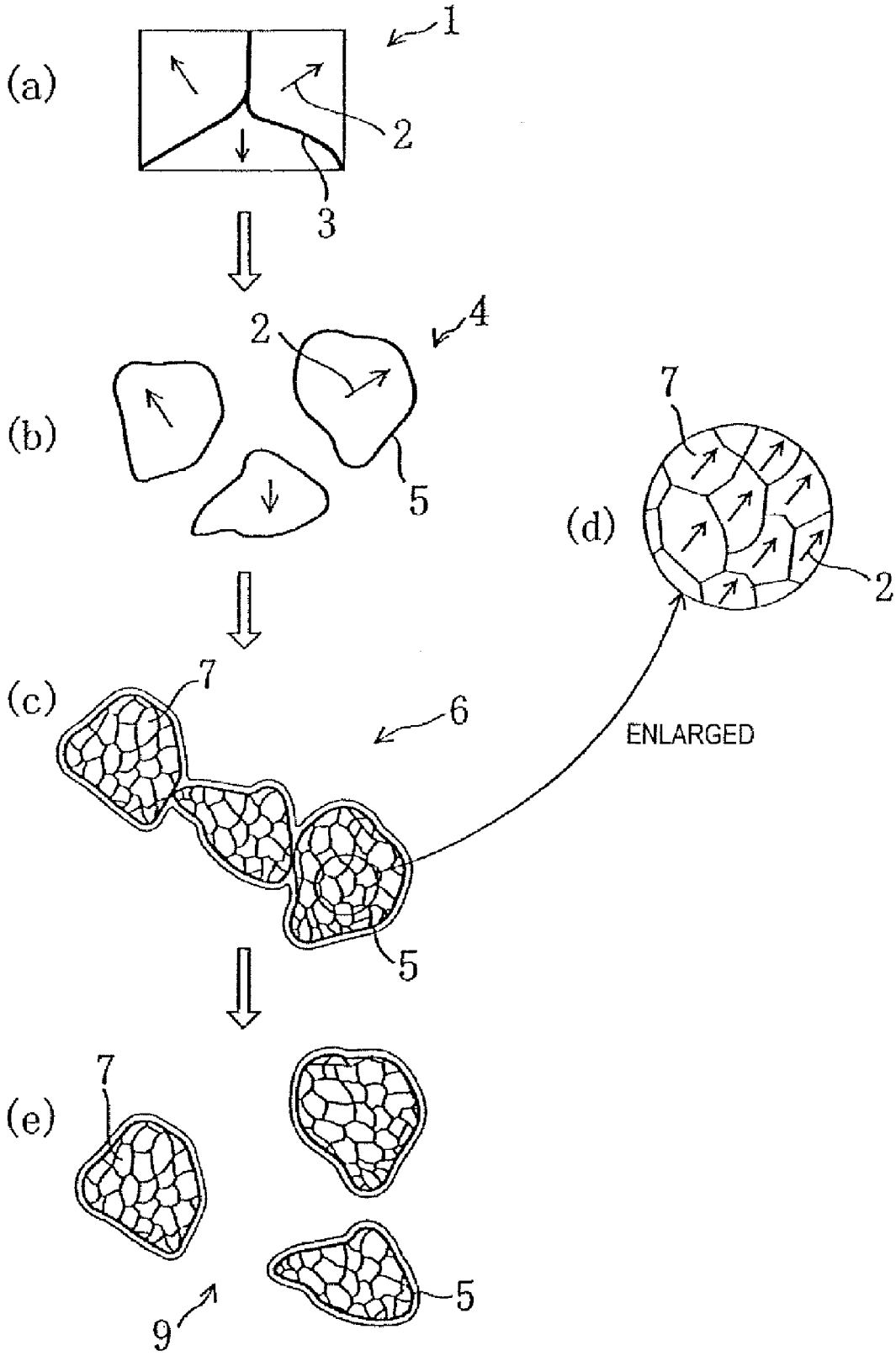
FIGS. 19(*a*) through 19(*e*) are schematic representations illustrating how to carry out an HDDR process.

FIGS. 17 and 18 are polarizing micrographs of a master alloy according to the present invention showing a texture cross section near its surface contacting with the cooling member and a texture cross section of a center portion in the thickness direction, respectively. In FIGS. 17 and 18, the upside shows a cooled surface while the downside shows a heat-dissipating surface (i.e., free surface). As can be seen from FIGS. 17 and 18, a very small crystal texture (i.e., the first texture layer) is present up to about 100 μm away from the contact surface, while coarse columnar crystals are present in the inner region (i.e., the second texture layer) that is more than about 100 μm away from the contact surface. In the vicinity of the free surface on the other hand, although the very small texture is observed here and there, this region is mostly made up of coarse crystals. The alloy cast flake has a thickness of 5 mm to 8 mm, and is mostly composed of the second texture layer consisting essentially of coarse columnar crystals. It should be noted that the boundary between the first and second texture layers is definite somewhere but indefinite elsewhere. As described above, the first texture layer is present up to about 100 μm away from the surface contacting with the cooling member, and accounts for at most several percents of the overall thickness of the alloy cast flake. The thickness of the first texture layer may reach about 5% of the overall thickness of the alloy cast flake depending on the cooling condition but is preferably less than 10%.

Comparing the texture structures of a plurality of alloy samples with different rare-earth contents, the present inventors discovered that the higher the concentration of the rare-earth element included, the smaller the crystal grain size of the alloy.

When a compositional image of coarse crystal grains was observed, it was confirmed that rare-earth-rich phases were dispersed there. The greater the amount of rare-earth elements included in the master alloy, the greater the number of dispersed rare-earth-rich phases identified in the coarse crystal grains. No α-Fe phases were observed.

Next, the master alloys with those various compositions were coarsely pulverized by a hydrogen decrepitation process. More specifically, the alloys were subjected to a hydrogen decrepitation process at 200° C. for 100 minutes within a hydrogen atmosphere, crushed with an agate mortar, and then classified with a sieve, thereby obtaining coarsely pulverized powders with sizes of 425 μm or less.

Thereafter, approximately 10 gram of the coarsely pulverized powder was subjected to an HDDR process. More specifically, a hydrogenation process (in which the temperature rise rate was 15° C./min, the processing temperature was 800° C., the processing time was 1 hour, and a hydrogen atmosphere was used), atmosphere replacement (in which the processing temperature was 800° C., the processing time was 5 minutes, the hydrogen atmosphere was replaced with an argon atmosphere and the flow rate of the argon gas was 5 litters per minute), and a dehydrogenation process (in which the processing temperature was 800° C., the processing time was 1 hour, the argon atmosphere was used continuously and the pressure of the argon gas was 2 kPa) were carried out.

The HDDR processed alloys were classified with a sieve and then the magnetic properties thereof were evaluated with a VSM on a particle size basis. Each sample, along with paraffin, was heated, cooled and fixed under a magnetic field, magnetized with a pulse magnetic field of about 5 MPa, and then the demagnetization curve thereof was plotted.

Figure 10:
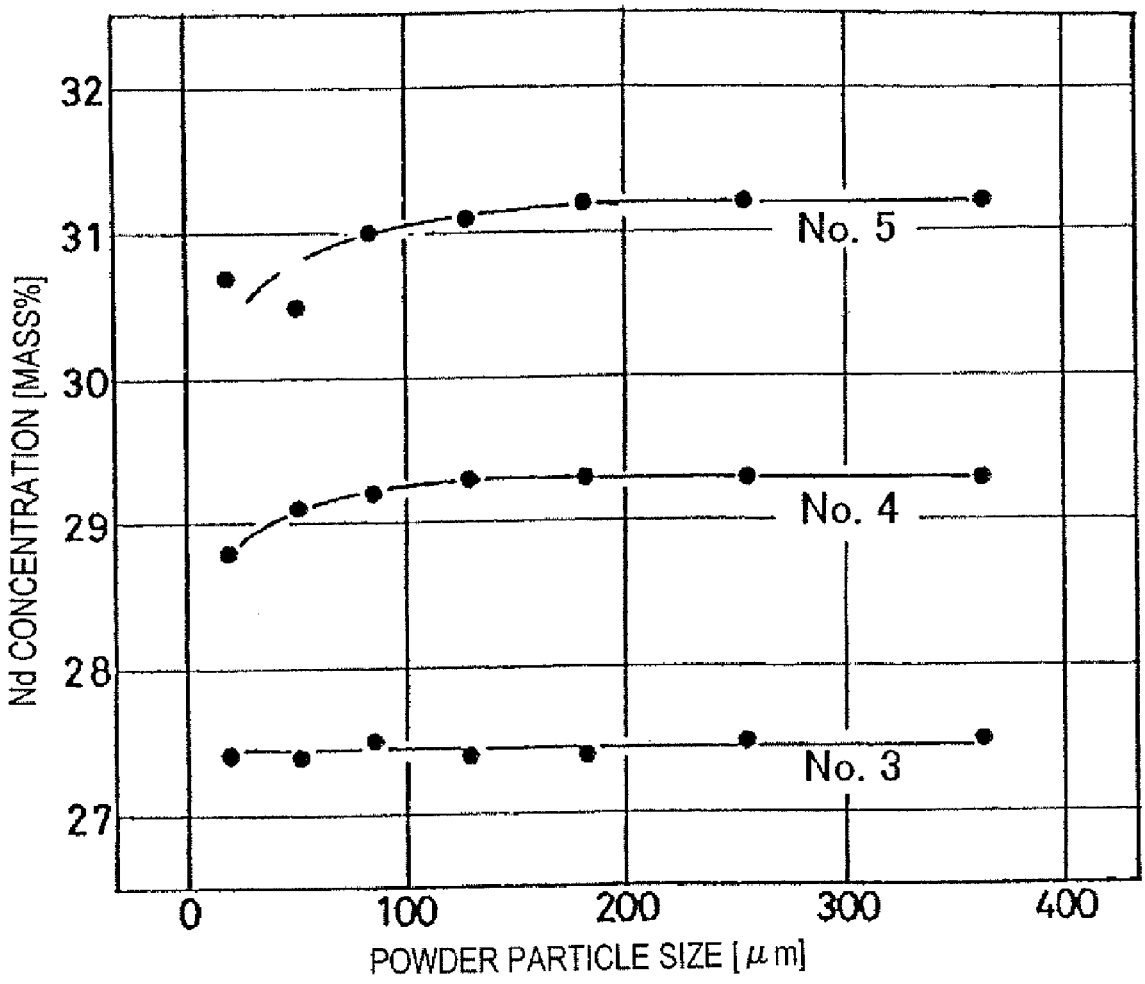
FIG. 10 is a graph showing the size-by-size Nd concentrations of coarse powders representing Samples Nos. 3, 4 and 5, in which the ordinate represents the Nd concentration in mass % and the abscissa represents the mean particle size in μm.

FIG. 10 shows the size-by-size Nd concentrations of coarse powders representing Samples Nos. 3, 4 and 5, in which the ordinate represents the Nd concentration in mass % and the abscissa represents the mean particle size in μm. In samples with high Nd contents such as Samples Nos. 4 and 5, the Nd concentration of a fine powder (e.g., with particle sizes of 50 μm or less) is lower than that of a coarse powder. In contrast, the B or Zr concentration had no particle size dependence although not shown in this graph.

This particle size dependence of the Nd concentration tends to be opposite to that of the conventional ingot cast alloy or strip cast alloy. That is to say, in the conventional ingot cast alloy or strip cast alloy, the Nd concentration of a fine powder (e.g., with particle sizes of 50 μm or less) is normally higher than that of a coarse powder.

In the conventional ingot cast alloy or strip cast alloy, rare-earth elements such as Nd are present on the grain boundary at a higher concentration than that defined by the stoichiometry of $R_2Fe_{14}B$ type crystals and within the crystal grains of the main phase at the value defined by the stoichiometry of $R_2Fe_{14}B$ type crystals, respectively. The hydrogen decrepitation process swells the grain boundary portion with the high rare-earth element concentration to make the alloy easy to crack from that portion Accordingly, the fine powder (with particle sizes of 50 μm or less), included in the coarsely pulverized powder made by the hydrogen decrepitation process, is likely to include the fine powder that has come from the grain boundary. Accordingly, the rare-earth content tends to increase.

In contrast, in the master alloy of the present invention, the rare-earth-rich phases are dispersed within the coarse crystal grains. That's why it is believed that the rare-earth element concentration on the grain boundary is not necessarily higher than that in the main phase in which the rare-earth-rich phases are dispersed. Also, within the main-phase crystal grains of the master alloy, the rare-earth-rich phases are dispersed at an interval of less than about 50 μm (e.g., 10 μm). Accordingly, little rare-earth-rich phases may be included in small powder particles.

Consequently, in the coarsely pulverized powder of the master alloy of the present invention, the concentration of the rare-earth elements included in fine powder particles with mean particle sizes of 50 μm or less is less than that of the rare-earth elements included in powder particles with mean particle sizes exceeding 50 μm. As can be seen from FIG. 10, this tendency is particularly remarkable where the master alloy has a high rare-earth content.

The alloy that has been subjected to the hydrogen decrepitation and coarse pulverization processes was thermally treated at 800° C. for 1 hour within a vacuum, thereby releasing hydrogen out of the alloy. Thereafter, the size-by-size magnetization of the material powder was measured with a VSM (under an external magnetic field $H_{ex}$ of 1.2 $MAm^{-1}$).

Figure 11:
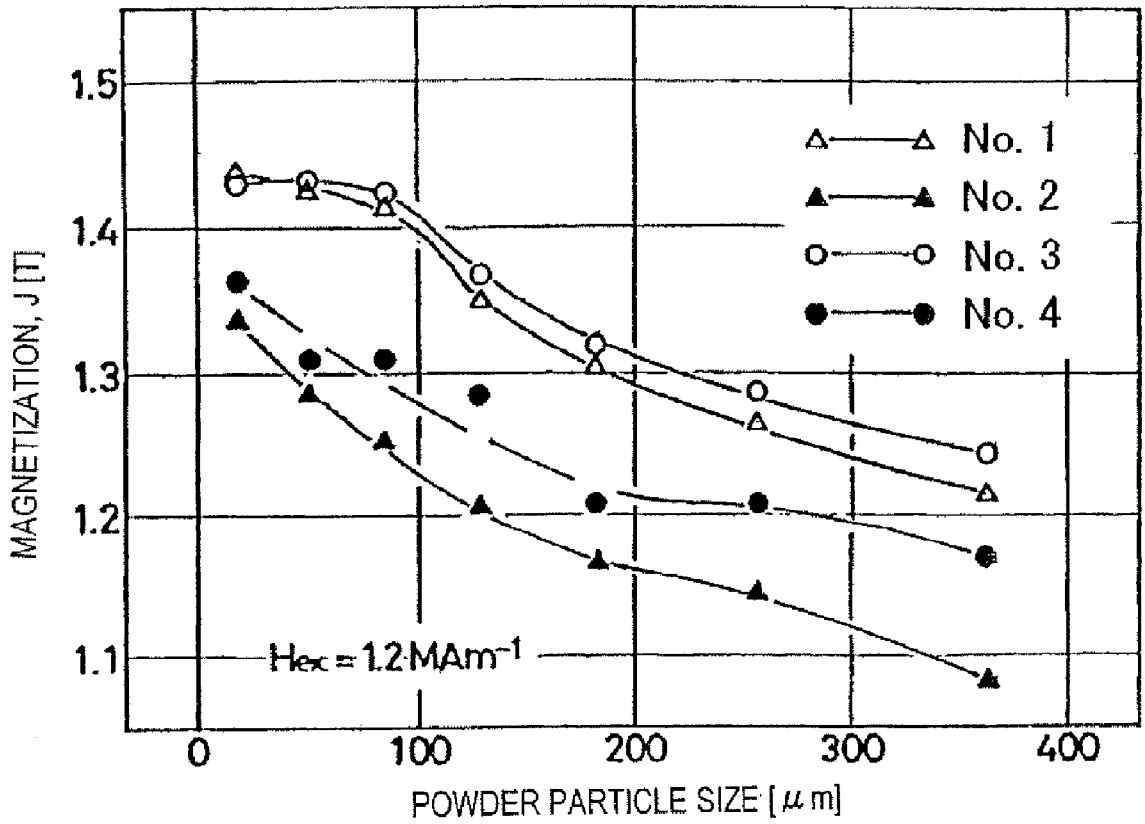
FIG. 11 is a graph showing the size-by-size magnetizations of coarse powders representing Samples Nos. 1, 2, 3 and 4, in which the ordinate represents the magnetization J in tesla and the abscissa represents the mean particle size in μm.

FIG. 11 shows the particle size dependences of the magnetization (in tesla) of Samples Nos. 1 through 4.

The magnetization has particle size dependence. That is to say, the greater the particle size, the lower the magnetization tends to be. There is almost no variation in composition among those particle sizes. Accordingly, it is believed that as the particle size increases, the degree of orientation of crystals decreases.

Figure 12:
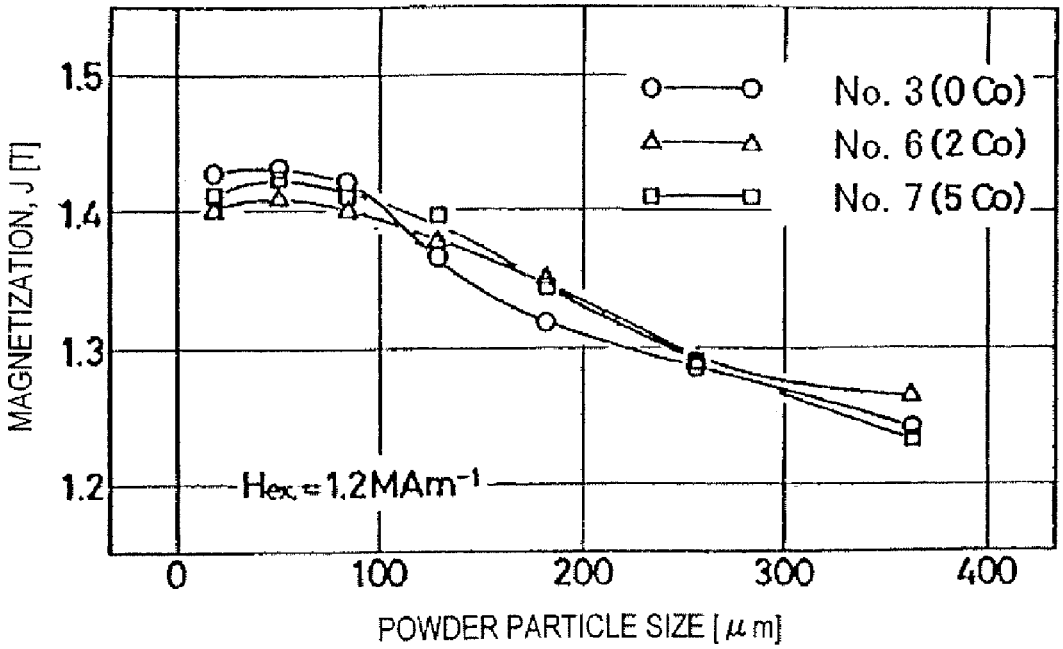
FIG. 12 is a graph showing the size-by-size magnetizations of coarse powders representing Samples Nos. 3, 6 and 7, in which the ordinate represents the magnetization J in tesla and the abscissa represents the mean particle size in μm.
Figure 13:
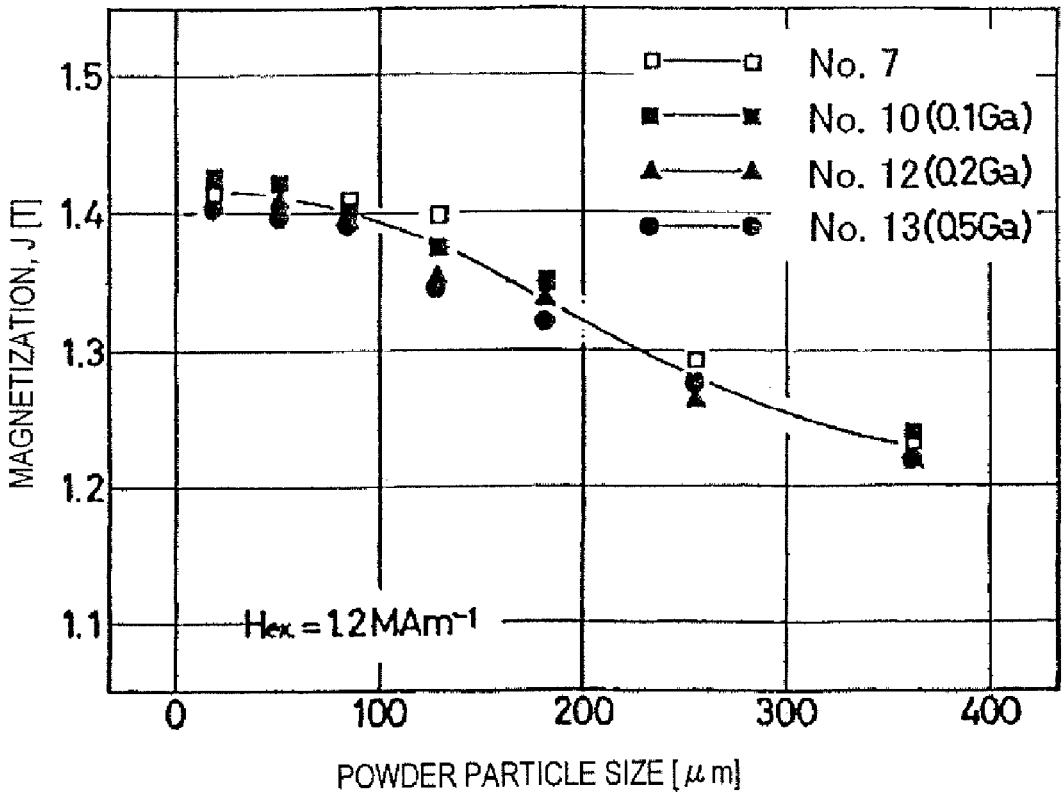
FIG. 13 is a graph showing the size-by-size magnetizations of coarse powders representing Samples Nos. 7, 10, 12 and 13, in which the ordinate represents the magnetization J in tesla and the abscissa represents the mean particle size in μm.
Figure 14:
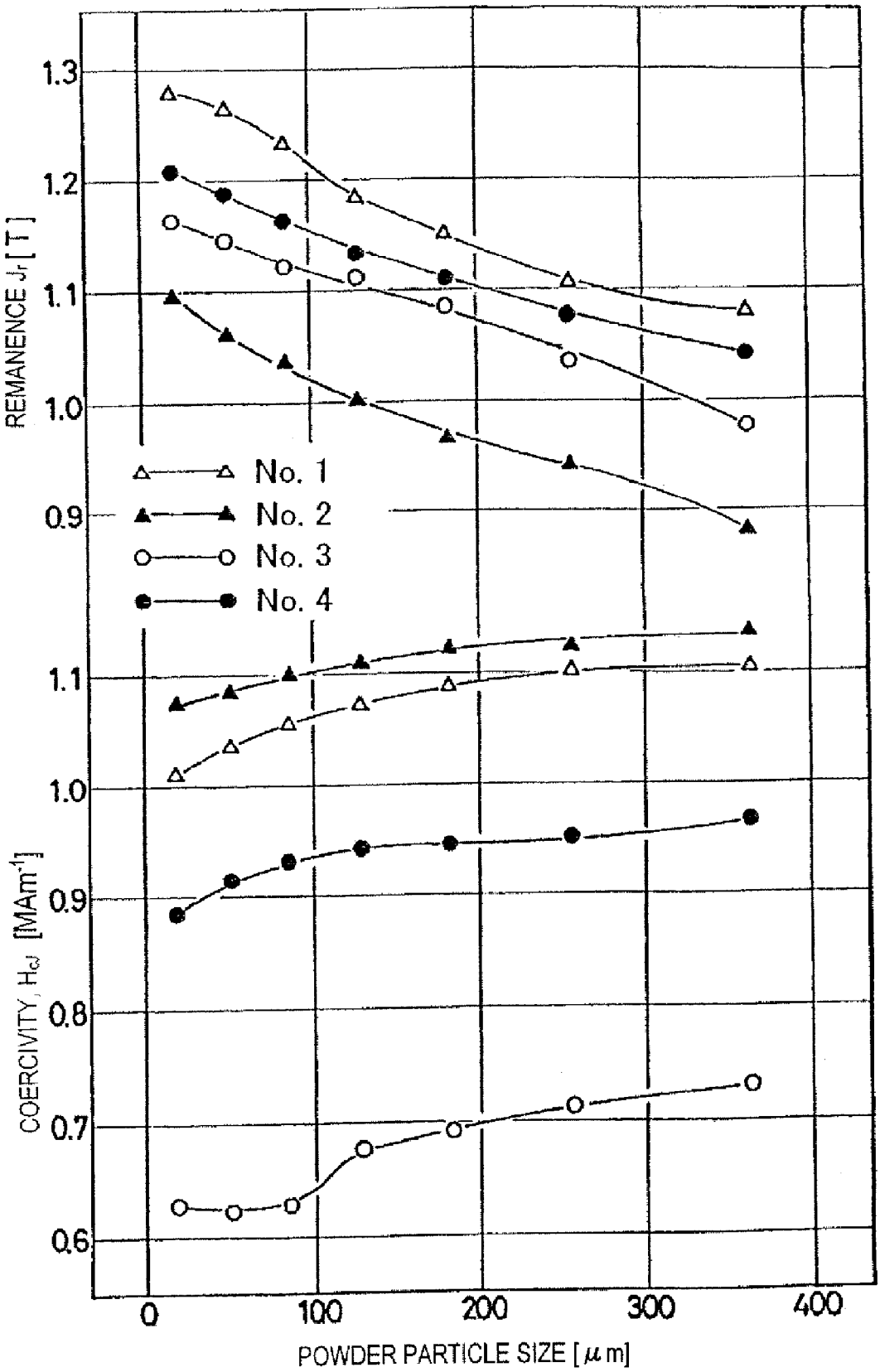
FIG. 14 is a graph showing the magnetic properties of Samples Nos. 1, 2, 3 and 4 that have been subjected to an HDDR process, in which the ordinate represents the remanence $J_r$ in tesla and intrinsic coercivity $H_{cJ}$ in $MAm^{-1}$ respectively, and the abscissa represents the mean particle size in μm.

FIG. 12 shows how the content of Co in the master alloy (i.e., in the material powder yet to be HDDR processed) affects the magnetization. FIG. 13 shows how the content of Ga in the master alloy (i.e., in the material powder yet to be HDDR processed) affects the magnetization. FIG. 14 shows the magnetic properties of Samples Nos. 1, 2, 3 and 4 that have been subjected to the HDDR process. It can be seen that even a sample to which no Co or Ga is added (i.e., an Nd—Fe—B—Zr based alloy) exhibits high magnetization if the Nd content thereof is high.

Figure 15:
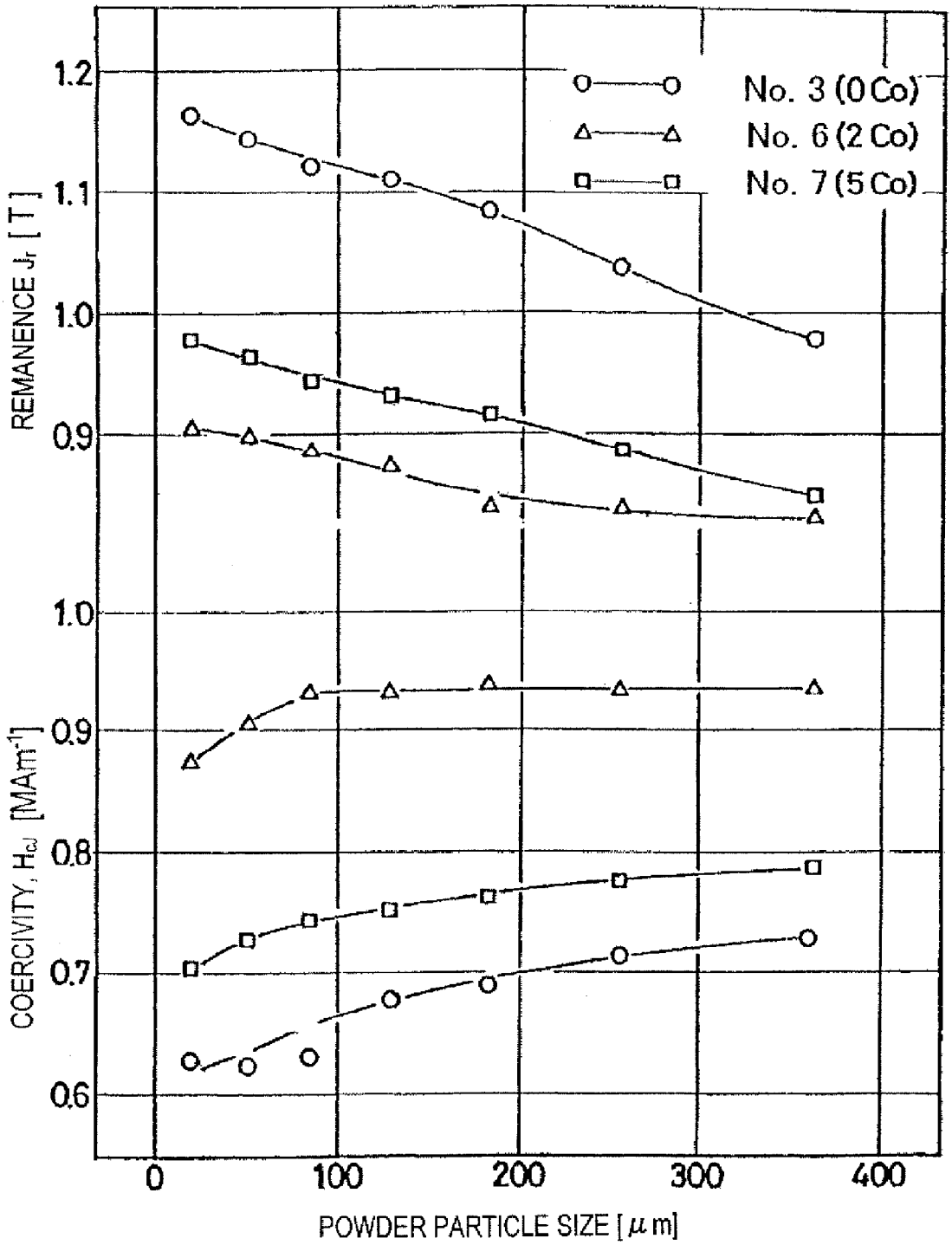
FIG. 15 is a graph showing the magnetic properties of Samples Nos. 3, 6, and 7 that have been subjected to an HDDR process, in which the ordinate represents the remanence $J_r$ in tesla and intrinsic coercivity $H_{cJ}$ in $MAm^{-1}$, respectively, and the abscissa represents the mean particle size in μm.

FIG. 15 shows how effective it is to add Co to the HDDR processed powder. If 2 at % of Co is added (as indicated by the data points ○ in this graph), the remanence decreases but the coercivity increases significantly. On the other hand, if 5 at % of Co is added (as indicated by the data points □ in this graph), the remanence does not decrease so much but the coercivity increases to a lesser degree.

Figure 16:
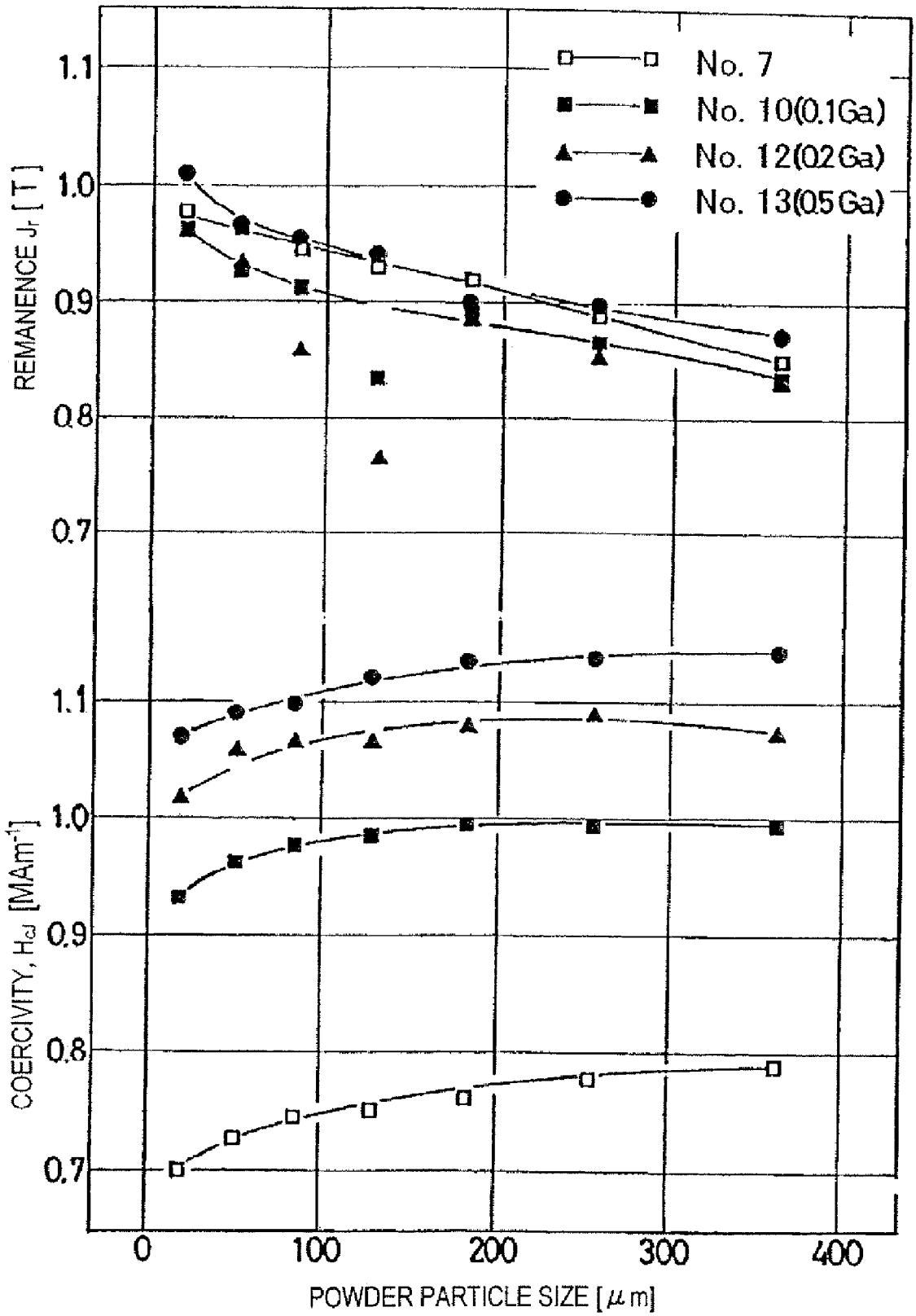
FIG. 16 is a graph showing the magnetic properties of Samples Nos. 7, 10, 12 and 13 that have been subjected to an HDDR process, in which the ordinate represents the remanence $J_r$ in tesla and intrinsic coercivity $H_{cJ}$ in $MAm^{-1}$ respectively, and the abscissa represents the mean particle size in μm.

FIG. 16 shows how effective it is to add Ga to the HDDR processed powder. It can be seen that the addition of Ga has almost no effects on the remanence but that the coercivity increases as the amount of Ga added increases.

As can be seen from the results shown in FIGS. 15 and 16, the addition of Co or Ga does not immensely contribute to increasing the remanence of the coarsely pulverized powder of the present invention. Thus, according to the present invention, there is no need to add Co or Ga for the purpose of increasing the remanence.

In the prior art, it has been believed preferable to add Co and Ca to the master alloy to obtain an HDDR powder. However, as is clear from these experimental results, even if no Co or Ga is added, a magnet powder with sufficiently good magnetic anisotropy can be obtained according to the present invention. Nevertheless, to reduce the temperature dependence of the magnetic properties, it is effective to add Co. Also, the addition of Co contributes to increasing the anti-corrosiveness. Thus, Co is preferably added according to the intended application. For example, if Co is added to a master alloy including 32 mass % of rare-earth element R, then the content of Co is preferably defined at 1 mass % or more to increase the anti-corrosiveness sufficiently.

In the present invention, if Ga is added, the magnetic properties are improvable to a certain degree as described above.

However, Ga is not always indispensable to achieve the objects of the present invention.

By mixing the HDDR powder thus prepared with a known binder and compacting the mixture under a magnetic field, an anisotropic bonded magnet with excellent magnet performance can be obtained. When applied as a permanent magnet to various types of motors and actuators, this anisotropic bonded magnet can exhibit excellent performance.

Example 2

First, a strip cast alloy and an ingot cast alloy, each having the same composition as Sample No. 10 shown in Table 1, were prepared. Next, each of these alloys was decrepitated by a hydrogenation process so as to be coarsely pulverized to sizes of 425 μm or less. Thereafter, the alloy was subjected to an HDDR process under the following conditions.

After having been once evacuated, the furnace has its internal pressure increased again with an argon gas supplied at the atmospheric pressure (i.e., 0.1 MPa). The samples were heated to 850° C. and then maintained at that temperature with the supply of the argon gas stopped and instead a hydrogen gas started to be supplied. These gases were exhausted (with the pressure maintained and) with an amount of hydrogen gas, corresponding to approximately 20% of the internal volume of the furnace, supplied into the furnace every minute. Such a state was maintained for two hours and then the supply of the hydrogen gas was stopped and instead an argon gas started to be supplied into the furnace with the in-furnace temperature kept substantially constant. In this manner, the argon gas was continuously introduced for five minutes, thereby replacing the atmosphere in the furnace with the argon gas. Thereafter, the in-furnace argon gas pressure was reduced with a rotary pump to 2 kPa, which state was maintained for one hour. Subsequently, an argon gas was supplied into the furnace again, thereby performing a cooling process with the in-furnace argon gas pressure raised to the atmospheric pressure.

This HDDR process is characterized by heating a sample to an elevated temperature (of 550° C. to 900° C.) within a non-hydrogen gas atmosphere and then supplying hydrogen into the furnace to start the hydrogenation process. By delaying the supply of hydrogen into the furnace until the temperature of the alloy has been raised sufficiently, it is possible to prevent the HDDR process from advancing excessively. The master alloy of the present invention is easier to react to hydrogen than the conventional alloy. That is why the HDDR process is preferably somewhat delayed by not allowing the alloy to react to hydrogen until the alloy has been heated to a high temperature.

Figure 20:
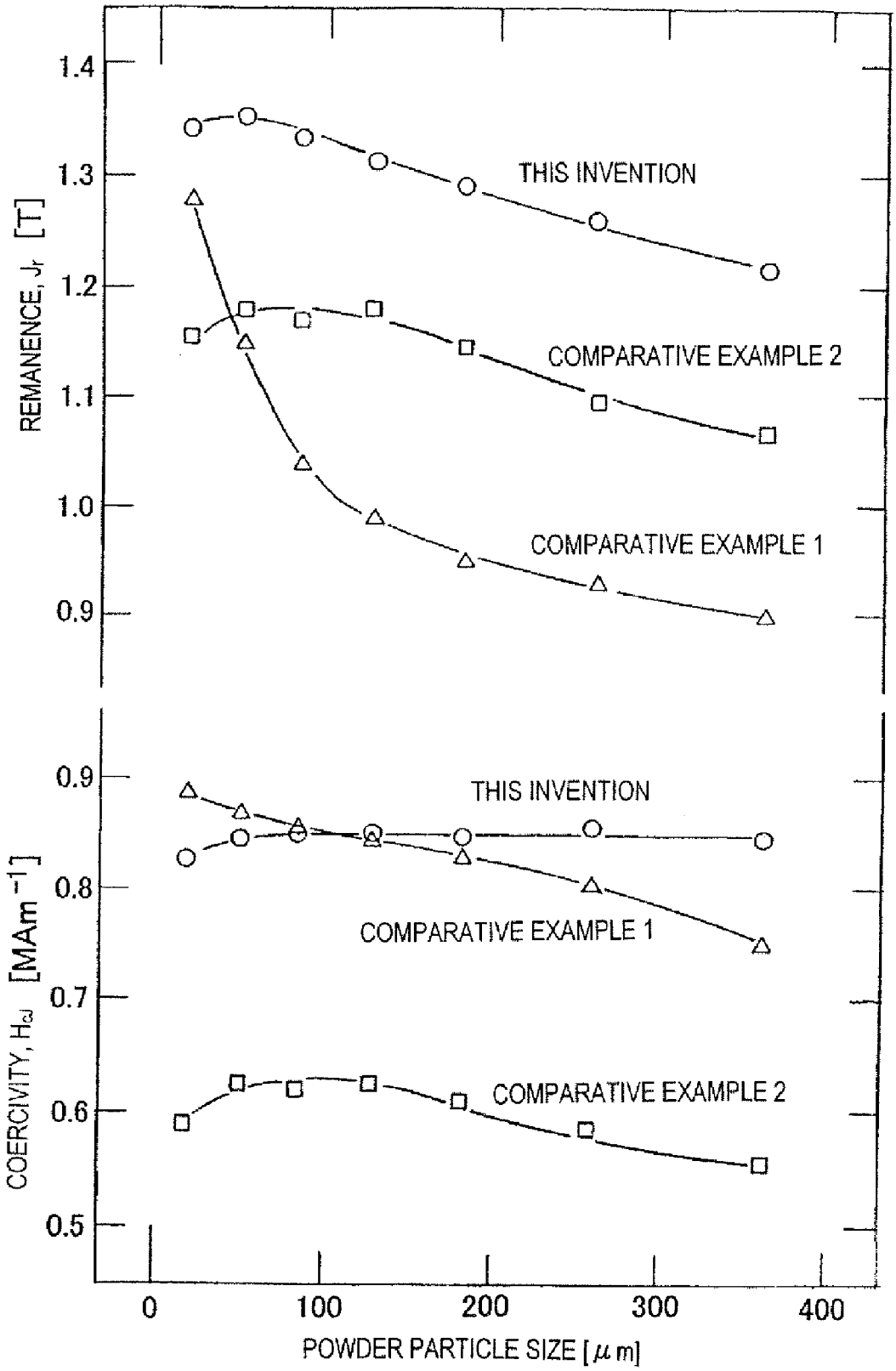
FIG. 20 is a graph showing what magnetic properties the master alloy of the present invention, the conventional ingot cast alloy and the strip cast alloy exhibit after having been subjected to an HDDR process, in which the ordinate represents the remanence $J_r$ in tesla and intrinsic coercivity $H_{cJ}$ in $MAm^{-1}$ respectively, and the abscissa represents the mean particle size in μm.

The powder samples, obtained by the HDDR process described above, were classified with a sieve, and then the remanences $J_r$ and coercivities $H_{cJ}$ of the samples were measured with a VSM on a particle size basis. The results of measurements are shown in FIG. 20. Comparing the results of the master alloy of the present invention (labeled as "This Invention"), the strip cast alloy (Comparative Example 1) and the ingot cast alloy (Comparative Example 2) with each other, it can be seen that the master alloy of the present invention exhibited excellent magnetic properties over a broad particle size range. It can also be seen that the master alloy of the present invention had its remanence increased by the HDDR process described above.

Figure 21:
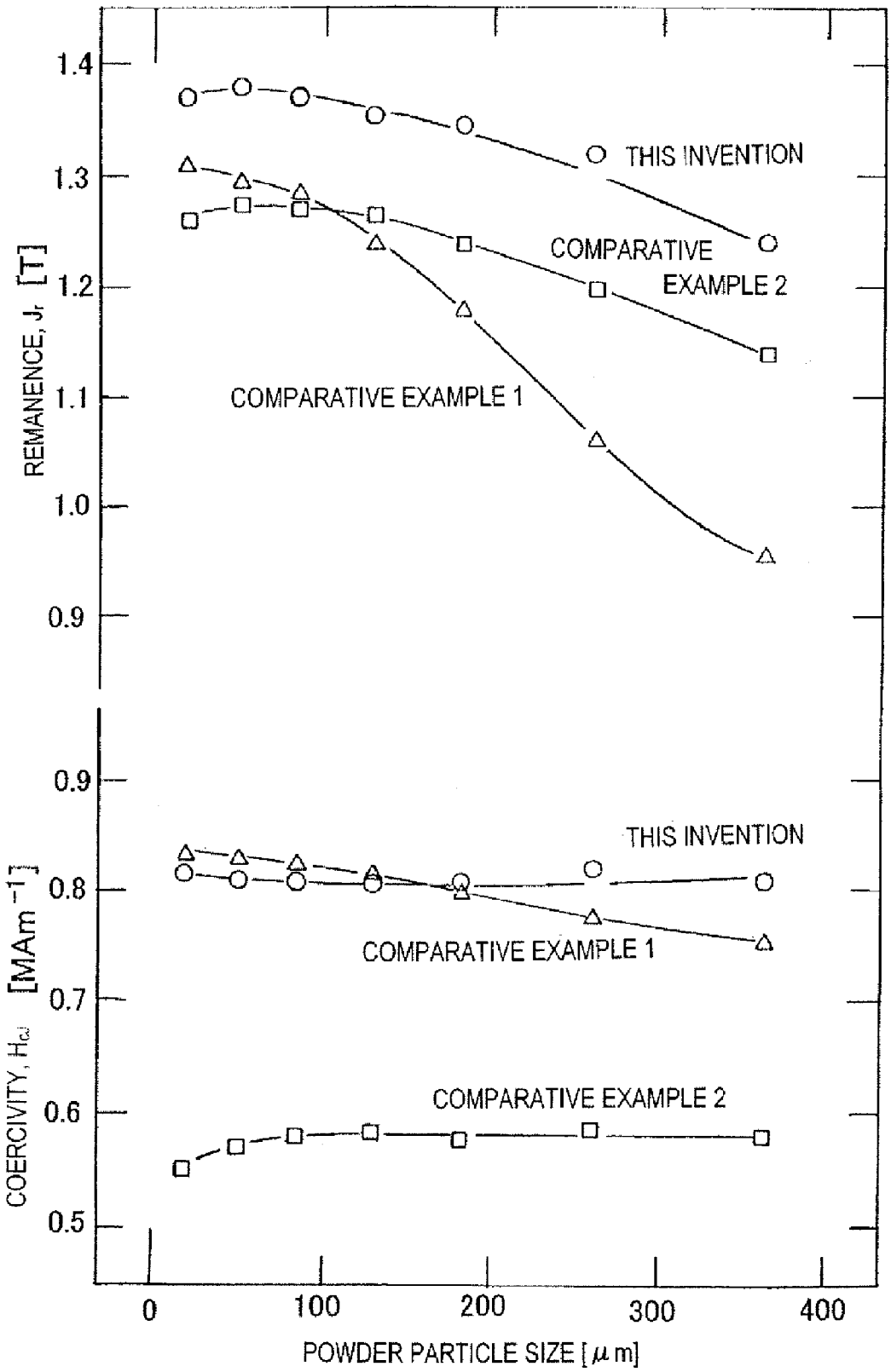
FIG. 21 is a graph showing what magnetic properties the master alloy of the present invention, the conventional ingot cast alloy and the strip cast alloy exhibit after having been subjected to a heat treatment at 1,020° C. and an HDDR process, in which the ordinate represents the remanence $J_r$ in tesla and intrinsic coercivity $H_{cJ}$ in $MAm^{-1}$, respectively, and the abscissa represents the mean particle size in μm.

The results shown in FIG. 21 were obtained by thermally treating the master alloy at 1,120° C. for 8 hours before subjecting it to the HDDR process described above. By subjecting the alloy to such a heat treatment at the higher temperature than the highest temperature of the HDDR process before subjecting it to the HDDR process, the remanence $J_r$ of the HDDR processed alloy increased advantageously.

Example 3

A molten alloy, having a composition consisting essentially of 27.0 mass % of Nd, 1.0 mass % of Dy, 15.0 mass % of Co, 0.6 mass % of Ga, 0.1 mass % of Zr, 1.0 mass % of B and Fe as the balance, was prepared and deposited on a cooling plate by a centrifugal atomization process, thereby making a master alloy. In this case, approximately 50% of gaps were created on its surface contacting with the cooling member By changing the amount of the melt sprayed, the rate of deposition on the cooling plate was adjusted. In this case, as the amount of the melt sprayed is increased, the deposition rate increases and the cooling rate of the molten alloy decreases. Conversely, as the amount of the melt sprayed is decreased, the deposition rate decreases and the cooling rate of the molten alloy increases. In this manner, master alloys were obtained at various cooling rates.

The cross sections of these master alloys were observed with a microscope, and the particle sizes of the main phases and the dispersion intervals of the rare-earth-rich phases were measured by an image processing technique. More specifically, the dispersion intervals were determined by a cutting process in which cut lines were defined parallel to a cooling substrate.

Then, the master alloy obtained in this manner was not subjected to any particular high-temperature heat treatment and subjected to a hydrogen decrepitation process so as to be coarsely pulverized to sizes of 425 μm or less. Thereafter, the alloy was subjected to an HDDR process, which was carried out in the following manner.

First, the samples were heated up to 800° C. and then maintained at 800° C. for two hours with a hydrogen gas at the atmospheric pressure (i.e., 0.1 MPa) introduced into the furnace. Then the supply of the hydrogen gas was stopped and instead an argon gas started to be supplied into the furnace. In this manner, the argon gas was continuously introduced for five minutes, thereby replacing the atmosphere in the furnace with the argon gas. Thereafter, the in-furnace argon gas pressure was reduced to 1 kPa, which state was maintained for one hour. Subsequently, an argon gas was supplied into the furnace again, thereby performing a cooling process with the in-furnace argon gas pressure raised to the atmospheric pressure. This HDDR process is different from the counterpart of the second example described above in that the samples were heated within the hydrogen gas atmosphere.

Figure 22:
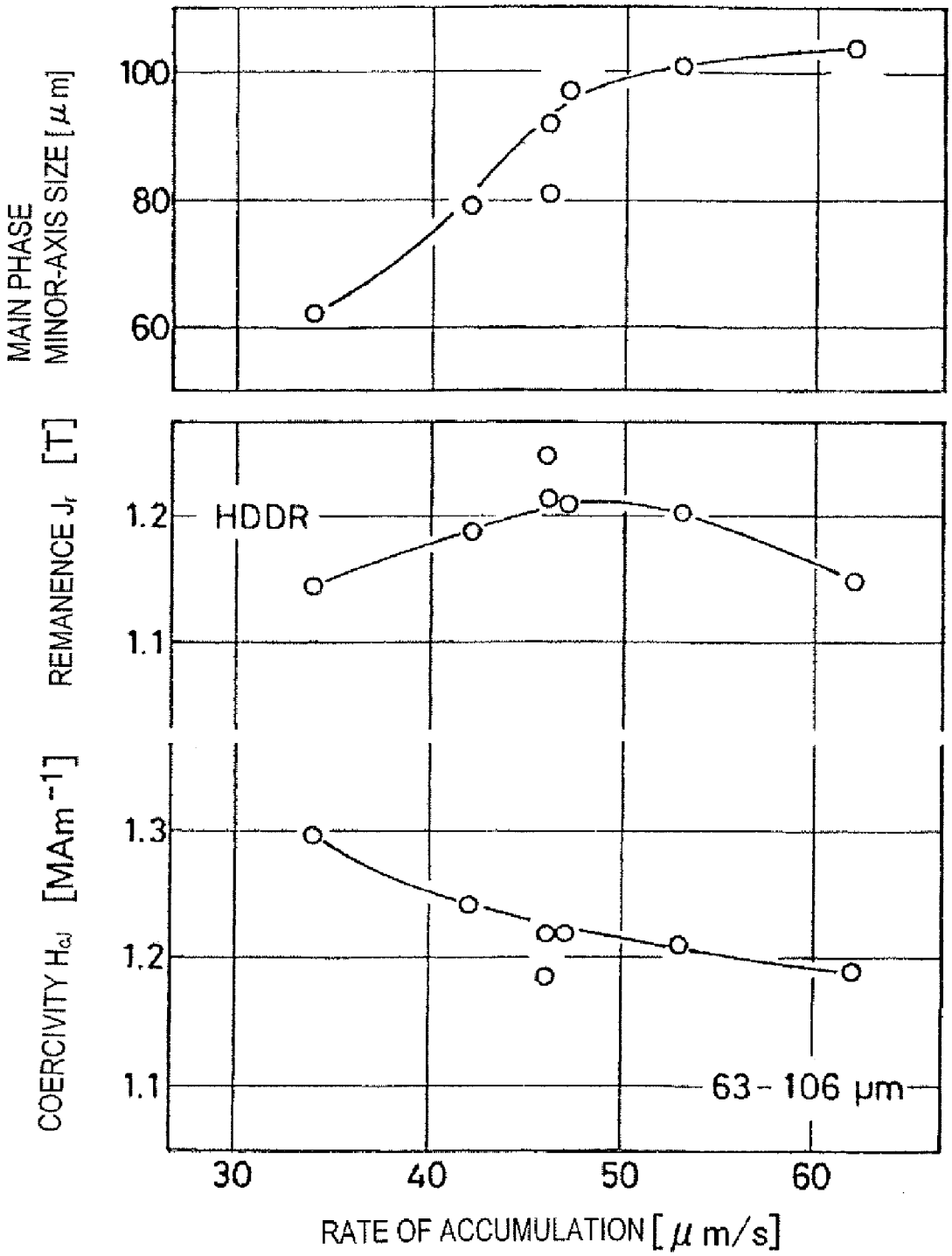
FIG. 22 is a graph showing how the master alloy of the present invention changes the main phase minor-axis size and post-HDDR magnetic properties with the rate of deposition (labeled as "rate of accumulation"), in which the ordinate represents the main phase minor-axis size (width of grain) in μm, remanence $J_r$ in tesla, and intrinsic coercivity $H_{cJ}$ in $MAm^{-1}$, respectively, and the abscissa represents the rate of deposition in μm/s.

FIG. 22 is a graph showing how the master alloy of the present invention changes the main phase minor-axis size and the post-HDDR magnetic properties with the deposition rate (labeled as "accumulation rate"). As can be seen from this graph, the higher the deposition rate, the greater the main phase minor-axis size. However, once the deposition rate exceeded 60 μm/s, the magnetic properties deteriorated. Thus, the deposition rate is preferably set equal to or lower than 60 μm/s.

Figure 23:
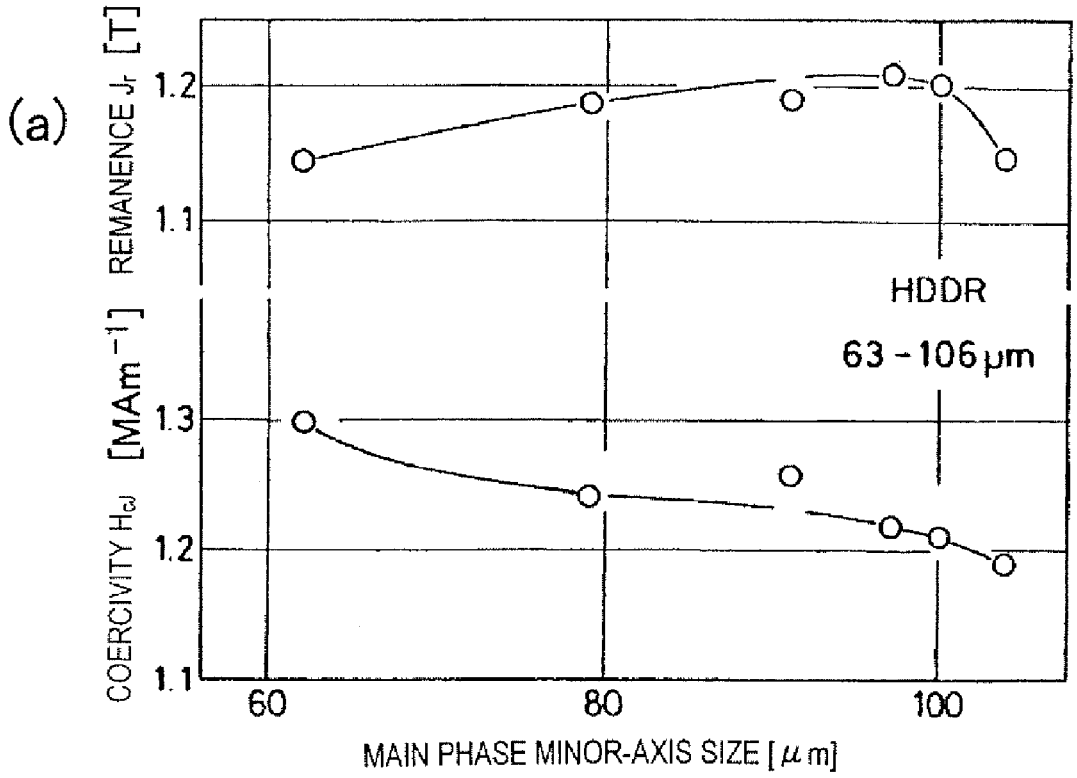
FIG. 23(*a*) is a graph showing relationships between the main phase minor-axis size and the post-HDDR magnetic properties of the master alloy of the present invention, in which the abscissa represents the average main phase minor-axis size.
Figure 23:
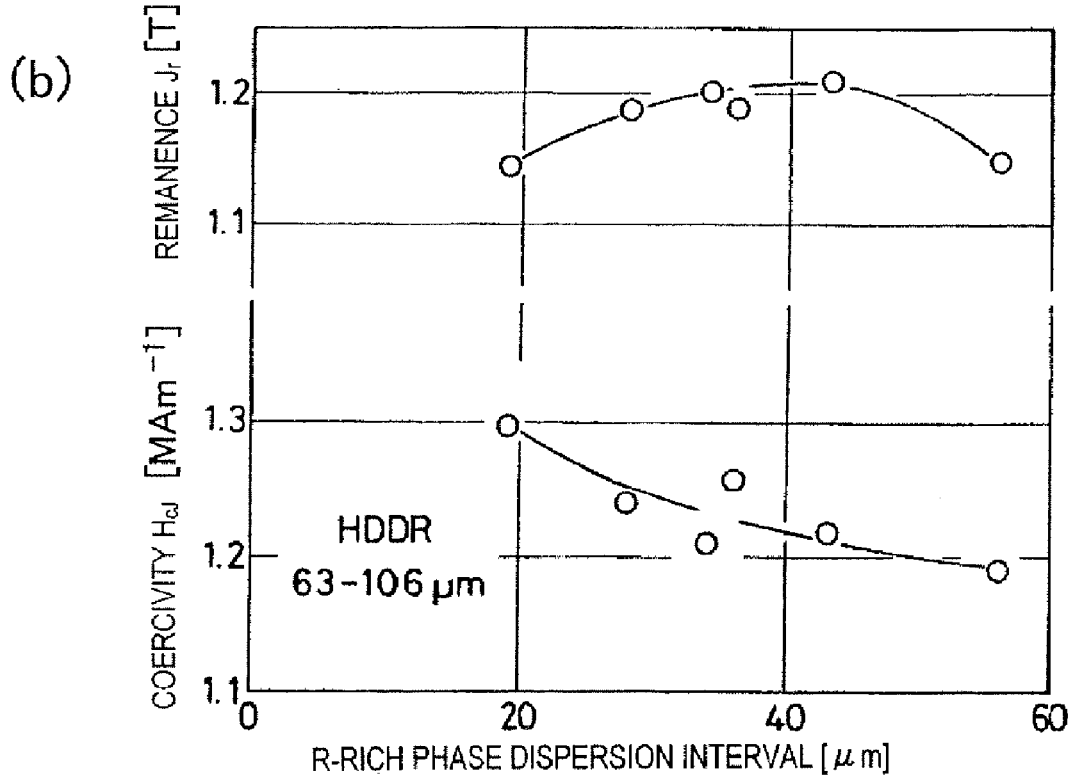

FIG. 23(*a*) is a graph showing relationships between the minor-axis size of the main phase and the post-HDDR magnetic properties of the master alloy of the present invention. FIG. 23(*b*) is a graph showing relationships between the rare-earth-rich phase dispersion interval and the post-HDDR magnetic properties of the master alloy.

Figure 24:
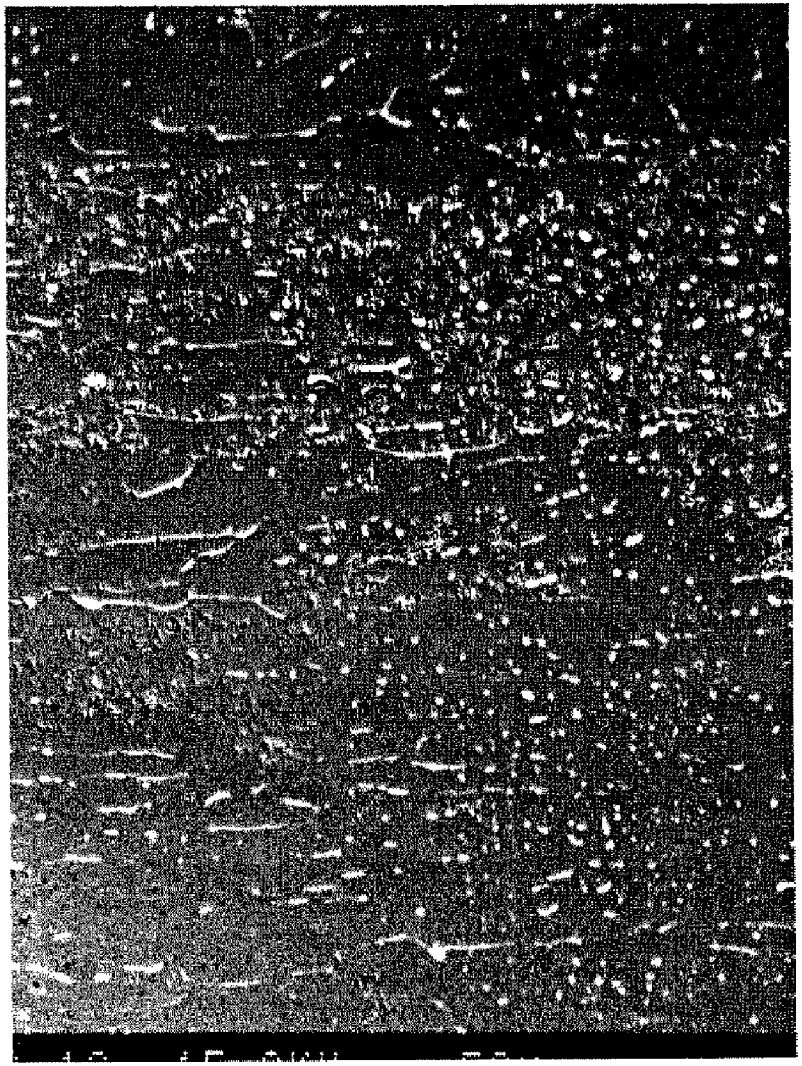
FIG. 24 is a photograph showing a backscattering electron image of a master alloy according to the present invention, which is being deposited at a rate of 34 μm/s by cooling a molten alloy.
Figure 25:
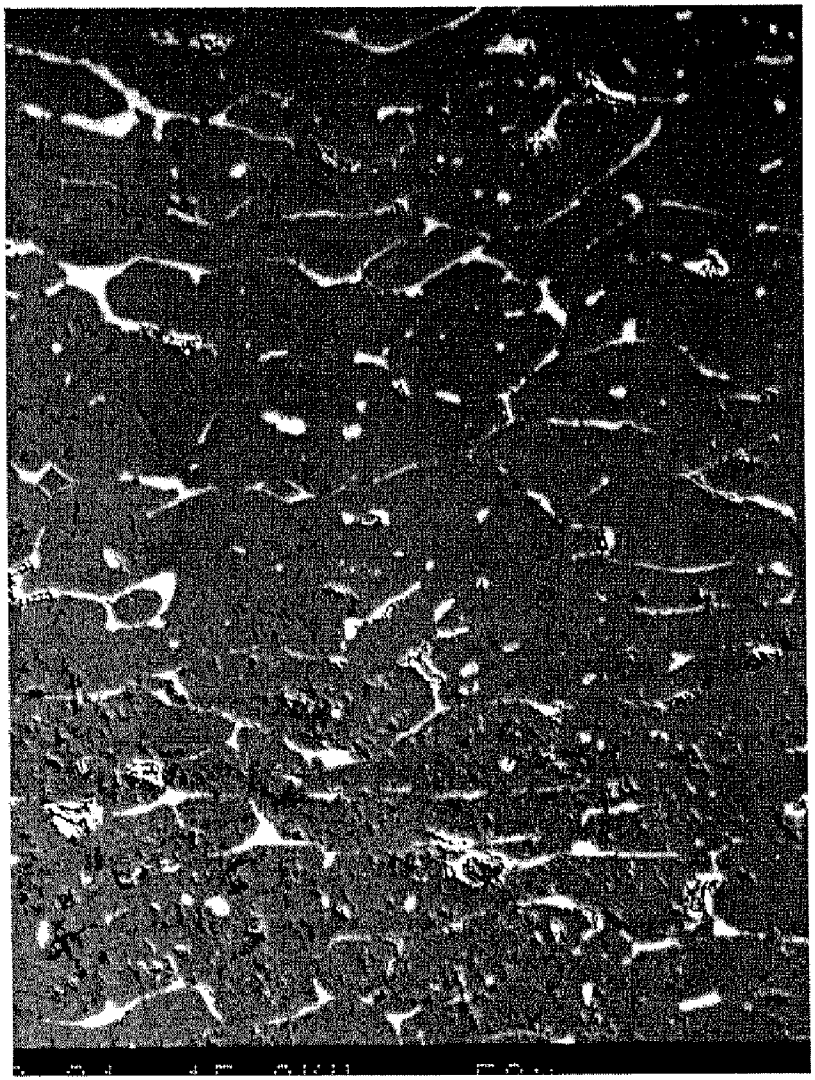
FIG. 25 is a photograph showing a backscattering electron image of a master alloy according to the present invention, which is being deposited at a rate of 47 μm/s by cooling a molten alloy.
Figure 26:
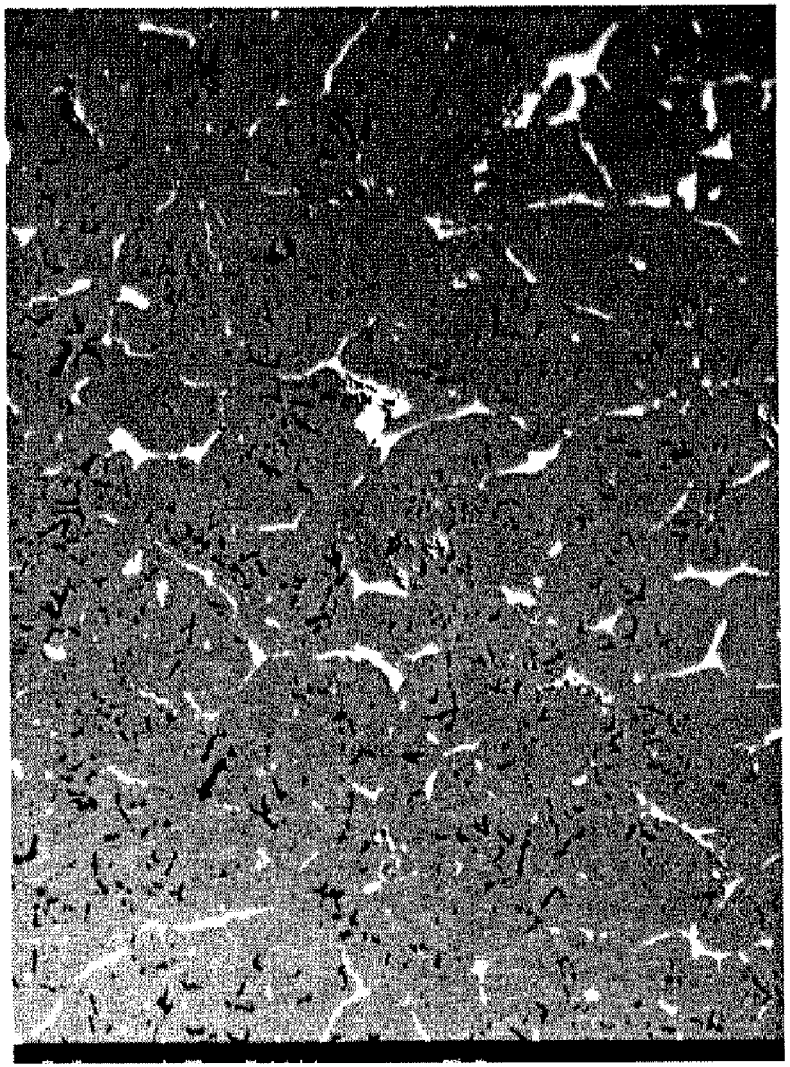
FIG. 26 is a photograph showing a backscattering electron image of a master alloy according to the present invention, which is being deposited at a rate of 62 μm/s by cooling a molten alloy.

FIGS. 24, 25 and 26 are photographs showing backscattering electron images of the master alloys of the present invention, which were deposited at rates of 34 μm/s, 47 μm/s and 62

μm/s, respectively, by cooling a molten alloy. As can be seen from these photographs, the higher the deposition rate of the master alloy, the greater the rare-earth-rich phase dispersion interval (i.e., space of R-rich). More specifically, when the deposition rates were 34 μm/s, 47 μm/s and 62 μm/s, the average dispersion intervals were 19 μm, 43 μm and 56 μm, respectively. In these photographs, dark portions represent the main phase, bright portions represent the rare-earth-rich phases, and black portions represent α-Fe. It should be noted that a length of 8 mm on these photographs is equivalent to an actual length of 50 μm.

INDUSTRIAL APPLICABILITY

According to the present invention, even without adding expensive Ca, an HDDR process can be carried out effectively and a big recrystallized texture with excellent magnetic anisotropy can be produced. As a result, the coercivity $H_{cJ}$ and remanence $J_r$ of the HDDR powder can be both increased. In addition, no homogenizing heat treatment needs to be carried out on the master alloy and the hydrogenation process time of the HDDR process can be shortened. Consequently, the manufacturing cost can be reduced and the manufacturing time can be shortened.

What is claimed is:

1. A rare-earth-iron-boron based alloy comprising: a first texture layer having gaps; and a second texture layer on the first texture layer, wherein the first texture layer accounts for less than 10 vol % of the overall alloy, the first texture layer consisting essentially of $R_2Fe_{14}B$ crystals (where R is at least one element selected from the group consisting of the rare-earth elements and yttrium) with an average minor-axis size of less than 20 μm, wherein the second texture layer comprises columnar $R_2Fe_{14}B$ crystals, the columnar $R_2Fe_{14}B$ crystals having an average minor-axis size of 20 μm to 110 μm, and wherein rare-earth-rich phases are dispersed at an average interval of 50 μm or less in the columnar $R_2Fe_{14}B$ crystals of the second texture layer.

2. The rare-earth-iron-boron based alloy of claim 1, wherein an α-Fe phase concentration of the alloy is 5 vol % or less.

3. The rare-earth-iron-boron based alloy of claim 1, wherein the rare-earth element has a concentration of 26 mass % to 32 mass %.

4. The rare-earth-iron-boron based alloy of claim 1, wherein a Ga concentration of the alloy is 0.6 mass % or less.

5. A powder of the rare-earth-iron-boron based alloy of claim 1, the powder having a mean particle size of 10 μm to 300 μm, wherein the concentration of rare-earth elements in powder particles with sizes of 50 μm or less is not higher than that of rare-earth elements in powder particles of which the sizes exceed 50 μm.

6. The powder of claim 5, wherein the powder is decrepitated by a hydrogen process.

7. A magnetically anisotropic rare-earth-iron-boron based alloy magnet powder including a rare-earth element at a concentration of 26 mass % to 32 mass %, an α-Fe phase at 5 vol % or less, and Ga at a concentration of 0.6 mass % or less, and wherein the magnetically anisotropic rare-earth-iron-boron based alloy magnet powder includes a fine texture produced by applying an HDDR process to the powder of claim 5.

8. An anisotropic bonded magnet including the magnetically anisotropic rare-earth-iron-boron based alloy magnet powder of claim 7.

9. A motor including the anisotropic bonded magnet of claim 8.

* * * * *